US007019717B2

(12) United States Patent
Yumoto et al.

(10) Patent No.: US 7,019,717 B2
(45) Date of Patent: Mar. 28, 2006

(54) ACTIVE-MATRIX DISPLAY, ACTIVE-MATRIX ORGANIC ELECTROLUMINESCENCE DISPLAY, AND METHODS OF DRIVING THEM

(75) Inventors: Akira Yumoto, Kanagawa (JP); Mitsuru Asano, Kanagawa (JP)

(73) Assignee: Sony Corporation, Tokyo (JP)

( * ) Notice: Subject to any disclaimer, the term of this patent is extended or adjusted under 35 U.S.C. 154(b) by 219 days.

(21) Appl. No.: 10/221,402

(22) PCT Filed: Jan. 11, 2002

(86) PCT No.: PCT/JP02/00152

§ 371 (c)(1),
(2), (4) Date: Sep. 11, 2002

(87) PCT Pub. No.: WO02/056287

PCT Pub. Date: Jul. 18, 2002

(65) Prior Publication Data

US 2003/0107560 A1 Jun. 12, 2003

(30) Foreign Application Priority Data

Jan. 15, 2001 (JP) ..... P2001-006387

(51) Int. Cl.
*G09G 3/30* (2006.01)

(52) U.S. Cl. ..... 345/76; 345/77; 315/169.3

(58) Field of Classification Search ..... 345/76–82, 345/39, 55, 45, 204, 211; 315/169.1, 169.3, 315/169.4

See application file for complete search history.

(56) References Cited

U.S. PATENT DOCUMENTS

| | | | | |
|---|---|---|---|---|
| 4,160,241 | A | 7/1979 | Shimizu et al. | |
| 4,864,216 | A | 9/1989 | Kalata et al. | |
| 5,952,789 | A * | 9/1999 | Stewart et al. | 315/169.4 |
| 6,091,203 | A | 7/2000 | Kawashima et al. | |
| 6,229,506 | B1 * | 5/2001 | Dawson et al. | 345/82 |
| 6,479,940 | B1 * | 11/2002 | Ishizuka | 315/169.3 |
| 6,501,466 | B1 * | 12/2002 | Yamagishi et al. | 345/204 |
| 6,542,138 | B1 * | 4/2003 | Shannon et al. | 345/76 |
| 6,580,408 | B1 * | 6/2003 | Bae et al. | 345/76 |
| 6,583,775 | B1 * | 6/2003 | Sekiya et al. | 345/76 |
| 6,693,610 | B1 * | 2/2004 | Shannon et al. | 345/76 |
| 6,731,276 | B1 * | 5/2004 | Ishizuka | 345/211 |

FOREIGN PATENT DOCUMENTS

| | | |
|---|---|---|
| EP | 1061497 | 12/2000 |
| JP | 11-282419 | 10/1999 |
| JP | 2000-338915 | 12/2000 |

* cited by examiner

*Primary Examiner*—Amr A. Awad
*Assistant Examiner*—Kimnhung Nguyen
(74) *Attorney, Agent, or Firm*—Sonnenschein, Nath & Rosenthal LLP

(57) ABSTRACT

When a current-writing type pixel circuit is made, it involves a greater number of transistors and TFTs occupy much of the area of the pixel circuit. To alleviate this problem, two pixel circuits (P1, P2) have a first scanning TFT (14), a current-voltage conversion TFT (16), respective second scanning TFTs (15-1, 15-2), capacitors (13-1,13-2), and drive TFTs (12-1, 12-2) for OLED including organic EL elements (11-2, 11-2) of two pixels, for example, in a row direction. In each of the pixel circuits, the first scanning TFT (14) handling a large amount of current (Iw) as compare with current flowing through the OLED (11-2, 11-2), and the current-voltage conversion TFT (16) are shared between two pixels.

16 Claims, 13 Drawing Sheets

FIG. 15A scan A (k)
FIG. 15B scan A (k+1)
FIG. 15C scan B (2k−1)
FIG. 15D scan B (2k)
FIG. 15E scan B (2k+1)
FIG. 15F scan B (2k+2)
FIG. 15G CURRENT FROM CS
valid data for 2k−1
valid data for 2k
valid data for 2k+1
valid data for 2k+2

ACTIVE-MATRIX DISPLAY, ACTIVE-MATRIX ORGANIC ELECTROLUMINESCENCE DISPLAY, AND METHODS OF DRIVING THEM

TECHNICAL FIELD

The invention relates to an active matrix type display device having an active element provided in each pixel wherein the active element performs a display control in pixel units, and to a method of driving the same. More particularly, it relates to an active matrix type display device having electro-optical elements whose luminance varies with the current flowing therethrough, as display elements for the pixel and to an active matrix type organic electroluminescent display device which utilizes organic electroluminescent (hereinafter called organic EL) elements as its electro-optical elements, and further to methods of driving such display devices.

BACKGROUND OF THE INVENTION

Recently, in the display devices such as liquid crystal display (LCD) utilizing liquid crystalline cells as the display elements for respective pixels, plural pixels are arranged in the form of a matrix, and respective pixels are driven to display image such that the light intensity of each pixel is controlled in accordance with image information representing the image to be displayed. Such driving technique also applies to organic EL displays utilizing organic EL elements as the display elements for pixels.

Moreover, the organic EL displays have advantages over liquid crystal displays such that the organic EL displays have a higher visibility, need no backlighting, and have faster response to signals due to the fact that the organic EL displays are self-luminous using light-emitting elements as the display elements for pixels. The organic EL displays are quite different from liquid crystal displays in that organic EL element is current-controlled type one wherein luminance of each light-emitting element is controlled by the current flowing through it, while liquid crystal cell is voltage-controlled type one.

Like liquid crystal displays, organic EL displays can be driven in a simple (passive) matrix scheme and in an active matrix scheme. The former displays, however, have some difficult problems when used as a large-size high-precision display, though the display is simple in structure. To circumvent the problems, an active matrix control scheme has been developed in which the current flowing through a light-emitting element for each pixel is controlled by an active element, for example, a gate-insulated field effect transistor (typically a thin film transistor, TFT) also provided in the pixel.

FIG. 1 shows a conventional pixel circuit (circuit of a unit pixel) in an active matrix type organic EL display (for more details, see U.S. Pat. No. 5,684,365 and JP-A-H08-234683).

As is shown clearly in FIG. 1, the conventional pixel circuit includes an organic EL element 101 having an anode connected to a positive voltage supply Vdd, a TFT 102 having a drain connected to a cathode of the organic EL element 101 and a grounded source, a capacitor 103 connected between a gate of the TFT 102 and the ground, and a TFT 104 having a drain connected to the gate of the TFT 102, a source connected to a data line 106, and a gate connected to a scanning line 105.

Organic EL elements are often called organic light-emitting diodes (OLED) because they exhibit rectifying effects in many cases. Thus, the organic EL element is shown in FIG. 1 and other Figures as an OLED and indicated by a mark representing a diode. It should be understood, however, that in what follows the organic EL element is not required to have a rectification property.

Operations of the pixel circuit as shown above are as follows. First, the scanning line 105 is brought to a selective potential (a HIGH level in the example shown herein), and the data line 106 is supplied with a writing potential Vw to make the TFT 104 conductive, thereby charging or discharging the capacitor 103 and bringing the gate of the TFT 102 to the writing potential Vw. Next, the scanning line 105 is brought to a non-selective potential (which is a LOW level in this example). This status electrically isolates the scanning line 105 from the TFT 102. However, the gate potential of the TFT 102 is secured by the capacitor 103.

The current flowing through the TFT 102 and OLED 101 will reach a level that corresponds to the gate-source voltage Vgs, which causes the OLED 101 to be lucent with a luminance in accord with the current values thereof. In what follows an operation that transmits luminance information data, provided on the data line 106 by a selection of scanning line 105, into the pixel will be referred to as "writing". In the pixel circuit as shown in FIG. 1, once potential Vw is written to the OLED 101, such the OLED 101 will be lighted at a constant luminance until the next writing is made.

A plurality of such pixel circuits 111 (which may be simply referred to as pixels) can be arranged in the form of a matrix as shown in FIG. 2 to form an active matrix type display (organic EL display) device, in which the pixels 111 are sequentially selected repeating the writing into the pixels 111 through data lines 114-1–115-m driven by voltage-driving-type data line drive circuit (voltage driver) 114 with scanning lines 112-1–112-n being sequentially selected by a scanning line drive circuit 113. In this example, pixels 111 are arranged in m (columns) by n (rows) matrix. It is a matter of course that in this case, there are m data lines and n scanning lines.

In a simple matrix type display device, each light-emitting element emits light only at the moment it is selected. In contrast, in an active matrix type display device, each light-emitting element can keep on emitting light after completion of the writing thereof. Accordingly, in the active matrix type display device, the peak luminance and peak current of light-emitting elements can be lower as compared with the simple matrix type display device, which is an advantage especially to a large size and/or high-precision display device.

In general, in the active matrix type organic EL display device, TFTs (thin film transistor) formed on a glass substrate are used as active elements. However, amorphous silicon (non-crystalline silicon) and polysilicon (polycrystalline silicon) to be used for forming TFTs have poor crystallizing properties as compared with silicon single crystal. This implies that they have a poor conductivity and controllability, so that TFTs exhibit large fluctuations in characteristics.

Particularly, when a polysilicon TFT is formed on a relatively large glass substrate, in order to circumvent problems caused by thermal deformation of the glass substrate, a laser annealing technique is usually applied to the glass substrate after formation of an amorphous silicon film to crystallize the polysilicon TFT. However, uniform irradiation of laser light over a large area of the glass substrate is difficult, resulting in non-uniform crystallization of polysilicon at various points on the substrate. As a result, threshold value Vth of TFTs formed on the same substrate varies over several hundreds of mV, and at least 1 volt in some cases.

In such cases, if the same potential Vw is written to these pixels, the threshold values Vth will be different from one pixel to another. Consequently, current Ids flowing through the OLED (organic EL element) varies from one pixel to another and can deviate greatly from a desired level. One cannot then anticipate getting a high quality display. This is true not only with the threshold Vth but also with a fluctuation in the mobility μ of carriers in the same manner.

In order to alleviate the problem, the inventors of the present invention have proposed a pixel circuit as shown in FIG. 3 (See JP-A-H11-200843).

As is apparent from FIG. 3, this pixel circuit disclosed in the formerly filed Japanese Patent Application includes an OLED 121 having an anode connected with a positive voltage supply Vdd, a TFT 122 having a drain connected to a cathode of OLED 121 and a source connected to a reference potential or ground line (herein after simply referred to as ground), a capacitor 123 connected between a gate of the TFT 122 and the ground, TFT 124 having a drain connected to the data line 128 and a gate connected to a first scanning line 127A, respectively, a TFT 125 having a drain and a gate connected to a source of TFT 124 and a source connected to the ground, a TFT 126 having a drain connected to the drain and the gate of the TFT 125 and a source connected to the gate of the TFT 122, and a gate connected to the second scanning line 127B.

As shown in FIG. 3, the scanning line 127A is supplied with a timing signal scanA. The second scanning line 127B is supplied with a timing signal scanB. The data line 128 is supplied with an OLED luminance information (data). A current driver CS provides a bias current Iw to the data line 128 in accordance with active current data based on the OLED luminance information.

In the example shown herein, the TFTs 122 and 125 are N channel MOS transistors and the TFTs 124 and 126 are P channel MOS transistors. FIGS. 4A–4D show timing charts for the pixel circuit in operation.

A definite difference between the pixel circuit shown in FIG. 3 and the one shown in FIG. 1 is as follows. In the pixel circuit shown in FIG. 1, luminance data is given to the pixels in the form of voltage, while in the pixel circuit shown in FIG. 3 luminance data is given to the pixels in the form of current. Corresponding operations are as follows.

First, in writing luminance information, scanning lines 127A and 127B shown in FIGS. 4A and 4B are set to the selective status (status of selective potential, for which scanA and scanB are pulled down to LOW levels) and data line 128 is fed with a current Iw as shown in FIG. 4C which corresponds to the OLED luminance information shown in FIG. 4D. The current Iw flows through the TFT 125 via the TFT 124. The gate-source voltage generated in the TFT 125 is set to Vgs. Since the gate and the drain of the TFT 125 are short-circuited, the TFT 125 operates in the saturation region.

Hence, in accordance with a well-known MOS transistor formula, Iw is given by $$Iw=\mu 1\mathrm{Cox}1W1/L1/2(\mathrm{Vgs}-\mathrm{Vth}1)^2 \quad (1)$$

where Vt1 stands for the threshold of TFT 125, μ1 for carrier mobility, Cox1 for gate capacitance per unit area, W1 for channel width, and L1 for channel length.

Denoting the current flowing through the OLED 121 by Idrv, it is seen that the current Idrv is controlled by the TFT 122 connected in series with OLED 121. In the pixel circuit as shown in FIG. 3, since the gate-source voltage of the TFT 122 equals Vgs given by equation (1), Idrv is given by $$Idrv=\mu 2\mathrm{Cox}2W2/L2/2(\mathrm{Vgs}-\mathrm{Vth}2)^2 \quad (2)$$

assuming that the TFT 122 operates in the saturation region.

Incidentally, it is known that a MOS transistor is generally operable in a saturation region under the following condition $$|Vds|>|Vgs-Vt| \quad (3)$$

Parameters appearing in the equations (2) and (3) are the same as in equation (1). Since the TFTs 125 and 122 are closely formed within the pixel, one may consider that practically $$\mu 1=\mu 2,\ \mathrm{Cox}1=\mathrm{Cox}2,\ \mathrm{Vth}1=\mathrm{Vth}2$$

Then, the following equation may be easily derived from the equations (1) and (2)

$$Idrv/Iw=(W2/W1)/(L2/L1) \quad (4)$$

That is, if carrier mobility μ, gate capacity per unit area Cox, and threshold Vth vary within the panel or vary from one panel to another, current Idrv flowing through the OLED 121 is exactly proportional to the writing current Iw, and hence the luminance of the OLED 121 can be precisely controlled. For example, if it is designed that W2=W1 and L2=L1, then Idrv/Iw=1, which means that writing current Iw matches current Idrv that flows through the OLED 121, irrespective of variations in TFT properties.

It is possible to construct an active matrix type display device by arranging pixel circuits as described above and shown in FIG. 3 in the form of a matrix. A configuration example of such display device is shown in FIG. 5.

Referring to FIG. 5, provided to each current-writing type pixel circuit 211 arranged in a m (column) by n (row) matrix on a row by row basis are any of respective first scanning lines 212A-1–212A-n and any of respective second scanning lines 212B-1–212B-n. Further, each first scanning line 212A-1–212A-n is connected to the gate of the TFT 214 of FIG. 3, and each scanning line 212B-1–212B-n is connected to the gate of the TFT 126 of FIG. 3.

A first scanning line drive circuit 213A for driving the scanning lines 212A-1–212A-n is provided to the left of these pixels, and a second scanning line drive circuit 213B for driving the second scanning lines 212B-1–212B-n is provided to the right of the pixels. The first and the second scanning line drive circuits 213A and 213B consists of shift registers. The scanning line drive circuits 213A and 213B are provided with a common vertical start pulse VSP, and with vertical clock pulses VCKA and VCKB, respectively. The vertical clock pulse VCKA is slightly delayed with respect to the vertical clock pulse VCKB by means of a delay circuit 214.

Each of the pixel circuits 211 in each column is also connected to any of respective data lines 215-1–215-m. These data lines 215-1–215-m are connected at one end thereof to a current drive type data line drive circuit (current driver CS) 216. Luminance information is written to the respective pixels by the data line drive circuit 216 through the data lines 215-1–215-m.

Next, operations of the above active matrix type display device will be described. As the vertical start pulses VSP are fed to the first and the second scanning line drive circuit 213A and 213B, respectively, these scanning line drive circuits 213A and 213B begin shift operations upon receipt of the vertical start pulses VSP, sequentially output scanning pulses scanA1–scanAn and scanB1–scanB1n in synchronism with the vertical clock pulses VCKA and VCKB to select scanning lines 212A-1–212A-n, and 212B-1–212B-n in sequence.

On the other hand, the data line drive circuit 216 drives the data lines 215-1–215-m according to current values determined by the luminance information. The current flows through the selected pixels that are connected to each of the scanning lines, to perform the writing operation on a scanning line basis. Each of these pixels starts emission of light with intensity in accord with the current values. It is noted that, as described previously, the vertical clock pulse VCKA is slightly behind the vertical clock pulse VCKB so that the scanning line 127B becomes non-selective ahead of the scanning line 127A, as seen in FIG. 3. At the point the scanning line 127B becomes non-selective, the luminance data is stored in the capacitor 123 within the pixel circuit, thereby maintaining constant luminance until new data is written into next frame.

In a case where a current mirror structure as shown in FIG. 3 is employed for the pixel circuit, a problem arises that the structure involves a larger number of transistors as compared with the one as shown in FIG. 1. That is, in the example shown in FIG. 1, each pixel is formed of two transistors, while, in the example shown in FIG. 3, each pixel requires four transistors.

Furthermore, in actuality, as disclosed in JP-A-11-200843, in many cases, a larger current Iw is needed for writing from data line as compared with the current Idrv flowing through a light-emitting element OLED. The reason for this is as follows. Current flowing through the light emitting element OLED is generally about a few μA even at the peak luminance. Hence, supposing gradation of 64 levels for the pixel, the magnitude of current in the neighborhood of the lowest gradation turns out to be several tens nA, which is however too small to be supplied correctly to the pixel circuit through a data line having a large capacitance.

This problem can be solved for a circuit shown in FIG. 3 by setting the factor (W2/W1)/(L2/L1) to a small value to thereby increase the writing current Iw in accordance with equation (4). To do this, however, it is necessary to make the ratio W1/L1 of TFT 125 large. In that case, since there are many limitations in reducing the channel length L1 as described later, the channel width W1 must be necessarily made larger, which results in a large TFT 125 occupying a large area of the pixel.

In the organic EL displays, when the dimensions of a pixel are generally fixed, this means that the area of light emitting section of the pixel must be reduced. This results in a loss of reliability of the pixel caused by increased current density, increased power consumption due to increased drive voltage, coarse graining of the pixels due to the decrease in the light emitting area, and the like, which prevent reduction of the pixel size, namely, hinders an improvement for a higher resolution.

For example, suppose that writing current on the order of a few μA is preferred in the neighborhood of the lowest level of gradation. Then it is necessary to make the channel width W1 of the TFT 122 as 100 times larger than that of the TFT 122 if L1=L2 is assumed. This is not the case if L1<L2. However, there are limitations on the reduction of the channel length L1 in view of withstand voltage of pixels and design rules.

Particularly in the current mirror constitution as shown in FIG. 3, it is preferred that L1=L2. This is because, considering the fact that the channel length greatly affects threshold value of a transistor, saturation characteristic in the saturation region thereof, and so on, it is advantageous to conform the TFTs 125 and 122 in the current mirror configuration by choosing L1 equal to L2 so that an exact proportional relationship of the current Idrv to the current Iw is established, which makes it possible to provide current of desired magnitude to the light emitting element OLED.

It is inevitable to have some fluctuations in the channel length during the manufacturing process of TFTs. Even then, if in design L1 equals L2 and the TFT 125 and TFT 122 are sufficiently close to each other, substantial equality L1=L2 is guaranteed, should L1 and L2 deviate to some extent. As a result, the value of Idrv/Iw according to the equation (4) remains substantially constant in spite of the fluctuations.

On the other hand, if in design L1<L2, but the actual channel lengths are shorter than the design lengths, then the shorter channel L1 will be more affected relatively than the other, rendering the ratio of L1 to L2 susceptible to the fluctuations during the manufacturing process and hence the ratio Idrv/Iw of equation (4). Consequently, dimensional fluctuations in channel length, if they occur on the same panel, can degrade the uniformity of an image formed.

Furthermore, in the circuit as shown in FIG. 3, it is necessary to made large the channel width of the TFT 124, serving as a switching transistor (hereinafter referred to as scanning transistor in some cases) connecting the data line to the TFT 125, because the writing current Iw flows through the TFT 124. This also causes a large pixel circuit occupying large area.

It is therefore an object of the invention to provide an active matrix type display device, an active matrix type organic EL display device, and methods of driving these display devices when pixel circuits are of writing current type, by realizing small pixel circuits occupying small areas to ensure a high resolution display and by realizing accurate current supply to each light emitting element.

SUMMARY OF THE INVENTION

A first active matrix type display device in accordance with the invention includes current-writing type pixel circuits arranged in a matrix form for allowing current to pass through the pixel circuits via a data line in accord with luminance to write luminance information thereinto, each pixel circuit having an electro-optical element whose luminance varies with the current passing therethrough, and the pixel circuit comprising a conversion part for converting the current provided from the data line into voltage, a hold part for holding the voltage converted by the conversion part, and a drive part for converting the voltage held in the hold part into current and passing the converted current through the electro-optical element, wherein the conversion part is shared between at least two separate pixels in a row direction.

A second active matrix type display device in accordance with the invention includes current-writing type pixel circuits arranged in a matrix form for allowing current to pass through the pixel circuits via a data line in accord with luminance to write luminance information thereinto, each pixel circuit having an electro-optical element whose luminance varies with the current passing therethrough, the pixel circuit comprising a first scanning switch for selectively passing the current provided from the data line, a conversion part for converting the current provided through the first scanning switch into voltage, a second scanning switch for selectively passing the voltage converted by the conversion part, a hold part for holding the voltage supplied thereto through the second scanning switch, and a drive part for converting the voltage held in the hold part into current and passing the converted current through the electro-optical element, wherein the first scanning switch is shared between at least two separate pixels in a row direction.

A method of driving an active matrix type display device in accordance with the invention comprises a step of setting second scanning switch to have a sequential selective status by sequentially selecting the preceding row and then the later row while first scanning switch has a selective status when writing to at least two separate pixels in a row direction.

A first active matrix type electroluminescent display device in accordance with the invention includes current-writing type pixel circuits arranged in a matrix form for allowing current to pass through the pixel circuits via a data line in accord with luminance to write luminance information thereinto, each pixel circuit utilizing as a display element organic electroluminescent element having a first electrode, a second electrode and layers of electroluminescent organic material, the layers being placed between the electrodes and including a light-emitting layer, the pixel circuit comprising a conversion part for converting the current provided from the data line into voltage; a hold part for holding the voltage converted by the conversion part; and a drive part for converting the voltage held in the hold part into current and passing the converted current through the organic electroluminescent element, wherein the conversion part is shared between at least two separate pixels in a row direction.

A second active matrix type electroluminescent display device in accordance with the invention includes current-writing type pixel circuits arranged in a matrix form for allowing current to pass through the pixel circuits via a data line in accord with luminance to write luminance information thereinto, each pixel circuit utilizing as a display element organic electroluminescent element having a first electrode, a second electrode and layers of electroluminescent organic material, the layers being placed between the electrodes and including a light-emitting layer, the pixel circuit comprising a first scanning switch for selectively passing the current provided from the data line, a conversion part for converting the current provided by the first scanning switch into voltage, a second scanning switch for selectively passing the voltage converted by the conversion part, a hold part for holding the voltage supplied thereto through the second scanning switch, and a drive part for converting the voltage held in the hold part into current and passing the converted current through the electro-optical element, wherein the first scanning switch is shared between at least two separate pixels in a row direction.

A method of driving an active matrix type electroluminescent display device in accordance with the invention comprises a step of setting second scanning switch to have a sequential selective status by sequentially selecting the preceding row and then the later row while first scanning switch has a selective status when writing to at least two separate pixels in a row direction.

In the active matrix type display device having the above configuration or an active matrix type organic EL display device utilizing organic EL elements as the electro-optical elements, the first scanning switch and conversion part are possibly designed to have a large area due to the fact that they deal with a large current as compared with the electro-optical elements. It is noted that the conversion part is used only when luminance information is written, and that the first scanning switch collaborates with the second scanning switch to perform scanning in a row direction (for a selected row). Noting this feature, either or both of the first scanning switch and/or the conversion part may be shared between multiple pixels in a row direction, to thereby decrease the area of the pixel circuit occupying each pixel, which would be otherwise much larger. In addition, if the area of the pixel circuit occupying each pixel is the same, a degree of freedom of layout design increases, so that current can be supplied to the electro-optical element more precisely.

DETAILED DESCRIPTION OF THE PRESENTLY PREFERRED EMBODIMENTS

Preferred embodiments of the invention will now be described in detail by way of example with reference to the accompanying drawings.

First Embodiment

Figure 6:
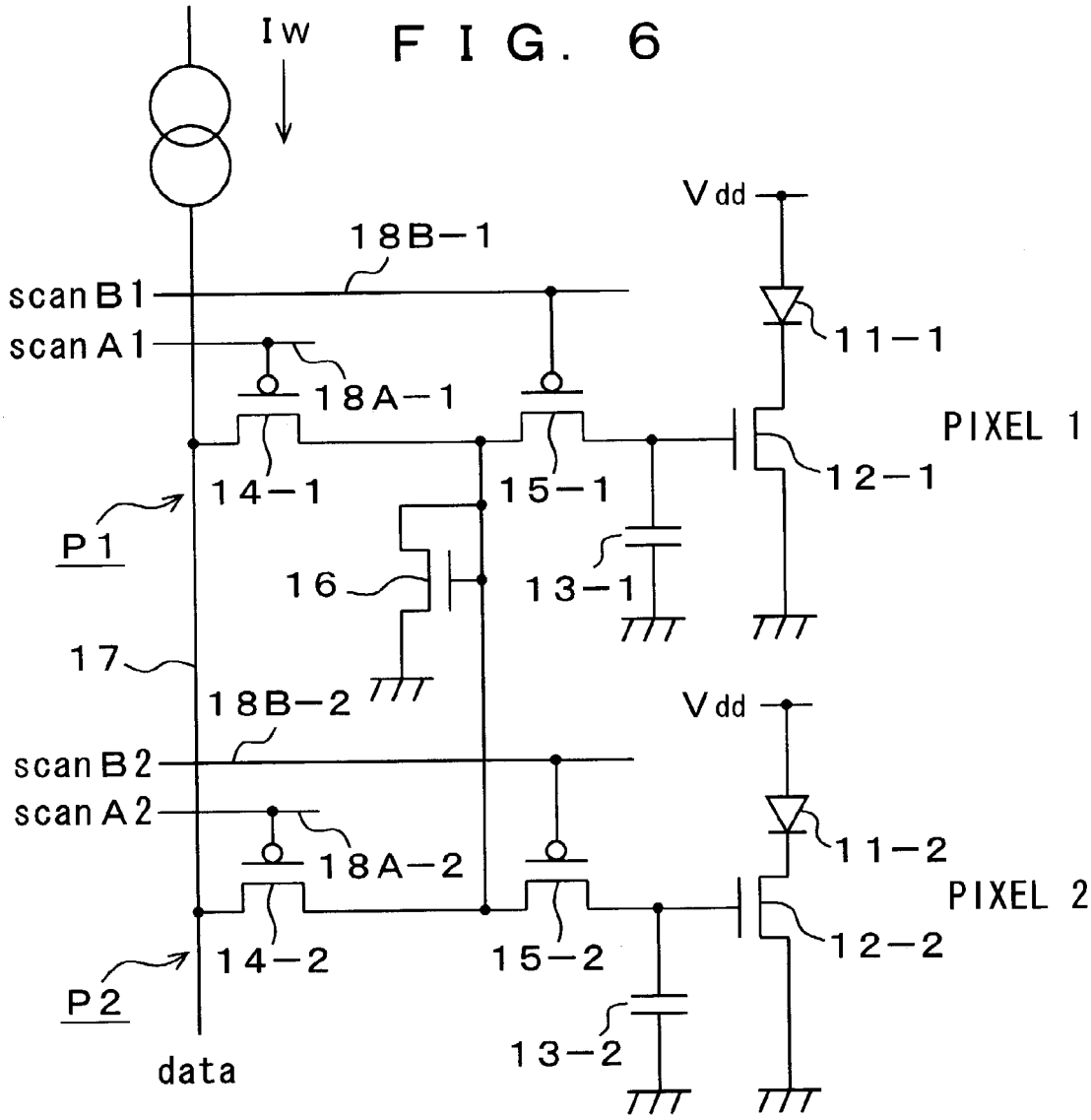
FIG. 6 is a circuit diagram showing a first embodiment of a current-writing type pixel circuit according to the invention.

FIG. 6 illustrates a circuit diagram of a first embodiment of a current-writing type pixel circuit according to the invention, in which only two neighboring pixels (pixel 1 and 2) in a column are shown for simplicity's sake in drawing.

As shown in FIG. 6, the pixel circuit P1 of pixel 1 comprises OLED (organic EL element) 11-1 having an anode connected to a positive voltage supply Vdd, a TFT 12-1 having a drain connected to a cathode of the OLED 11-1 and a grounded source, a capacitor 13-1 connected to a gate of the TFT12-1 and the ground (reference potential point), a TFT 14-1 having a drain connected to a data line 17 and a gate connected to a first scanning line 18A-1, respectively, a TFT 15-1 having a drain connected to a source of TFT 14-1, a source connected to the gate of the TFT 12-1, and a gate connected to a second scanning line 18B-1, respectively.

Similarly, the pixel circuit P2 of pixel 2 comprises OLED 11-2 having an anode connected to the positive voltage source Vdd, a TFT 12-2 having a drain connected to a cathode of the OLED 11-2 and a grounded source, a capacitor 13-2 connected to a gate of the TFT 12-2 and the ground, a TFT 14-2 having a drain connected to the data line 17, and a gate connected to a first scanning line 18A-2, respectively, a TFT 15-2 having a drain connected to a source of the TFT14-2, a source connected to the gate of the TFT 12-2, and a gate connected to a second scanning line 18B-2, respectively.

A so-called diode connection type TFT 16 whose drain and gate are short-circuited is shared between the pixel circuits P1 and P2 of the two pixels. That is, the drain and the gate of the TFT 16 are respectively connected to the source of the TFT 14-1 and the drain of the TFT 15-1 of the pixel circuit P1 and to the source of the TFT 14-2 and the drain of the TFT 15-2 of the pixel circuit P2, respectively. The source of the TFT 16 is grounded.

In the example shown herein, the TFTs 12-1 and 12-2 and the TFT 16 are N-channel MOS transistors, while the TFTs 14-1, 14-2, 15-1, and 15-2 are P-channel MOS transistors.

In the above arrangement of the pixel circuits P1 and P2, the TFTs 14-1 and 14-2 function as a first scanning switch for selectively supplying the TFT 16 with current Iw provided from the data line 17. The TFT 16 functions as a conversion part for converting the current Iw supplied from the data line 17 via the TFTs 14-1 and 14-2 into voltage and constitutes current mirror circuit together with the TFTs 12-1 and 12-2, which will be described later. The reason why the TFT 16 can be shared between the pixel circuits P1 and P2 is that the TFT 16 is used only at the moment of writing by the current Iw.

The TFTs 15-1 and 15-2 function as a second scanning switch for selectively supplying the capacitors 13-1 and 13-2 with the voltage converted by the TFT 16. The capacitors 13-1 and 13-2 function as hold parts for holding the voltages, which are converted from the current by the TFT 16 and supplied via the TFTs 15-1 and 15-2. The TFTs 12-1 and 12-2 function as drive parts for converting the voltages held in the respective capacitors 13-1 and 13-2 into respective currents and passing the converted currents through the OLED 11-1 and 11-2 to allow the OLED 11-1 and 11-2 to emit light. The OLEDs 11-1 and 11-2 are electro-optical elements whose luminance varies with the currents passing through them. Detailed structures of the OLEDs 11-1 and 11-2 will be described later.

Writing operations of the first embodiment of the pixel circuit described above for writing luminance data will now be described.

First, consider writing luminance data to the pixel 1. In this case, the current Iw is provided with the data line 17 in accordance with the luminance data with both of the scanning lines 18A-1 and 18B-1 being selected (in the example shown herein, scanning signals scanA1 and scanB1 are both LOW levels). The current Iw is supplied to the TFT 16 via the currently conductive TFT 14-1. Because of the current Iw flowing through the TFT 16, voltage corresponding to the current Iw is generated on the gate of the TFT 16. This voltage is held in the capacitor 13-1.

This causes current to flow through the OLED 11-1 via the TFT 12-1 in response to the voltage held in the capacitor 13-1. Thus, an emission of light starts in the OLED 11-1. The writing of the luminance data to pixel 1 is completed when both the scanning lines 18A-1 and 18B-1 assume non-selective status (scanning signal scanA1 and scanB1 being pulled to HIGH levels). During the sequence of steps described above, scanning line 18B-2 stays in the non-selective status, so that OLED 11-2 of the pixel 2 keeps on emitting light with the luminance determined by the voltage held in the capacitor 13-2, without being affected by the writing to the pixel 1.

Next, consider writing luminance data to the pixel 2. This can be done by selecting both of the scanning lines 18A-2 and 18B-2 (with scanning signal scanA-2 and scanB-2 being LOW levels), and by supplying current Iw to the data line 17 in accordance with the luminance data. Because of the current Iw flowing through the TFT 16 via the TFT 14-2, voltage corresponding to the current Iw is generated on the gate of the TFT 16. This voltage is held in the capacitor 13-2.

Current corresponding to the voltage held in the capacitor 13-2 flows through the OLED 11-2 via the TFT 12-2, thereby causing the OLED 11-2 to emit light. During the sequence of the steps described above, scanning line 18B-1 maintains the non-selective status, so that OLED 11-1 of the pixel 1 continues light emission with the luminance determined by the voltage held in the capacitor 13-1, without being affected by the writing to the pixel 2.

Figure 1:
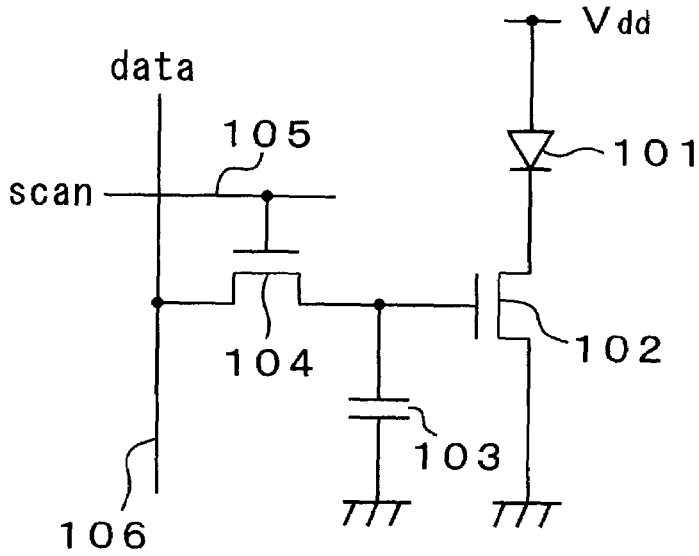
FIG. 1 (PRIOR ART)
FIG. 1 is a circuit diagram of a conventional pixel circuit.
Figure 3:
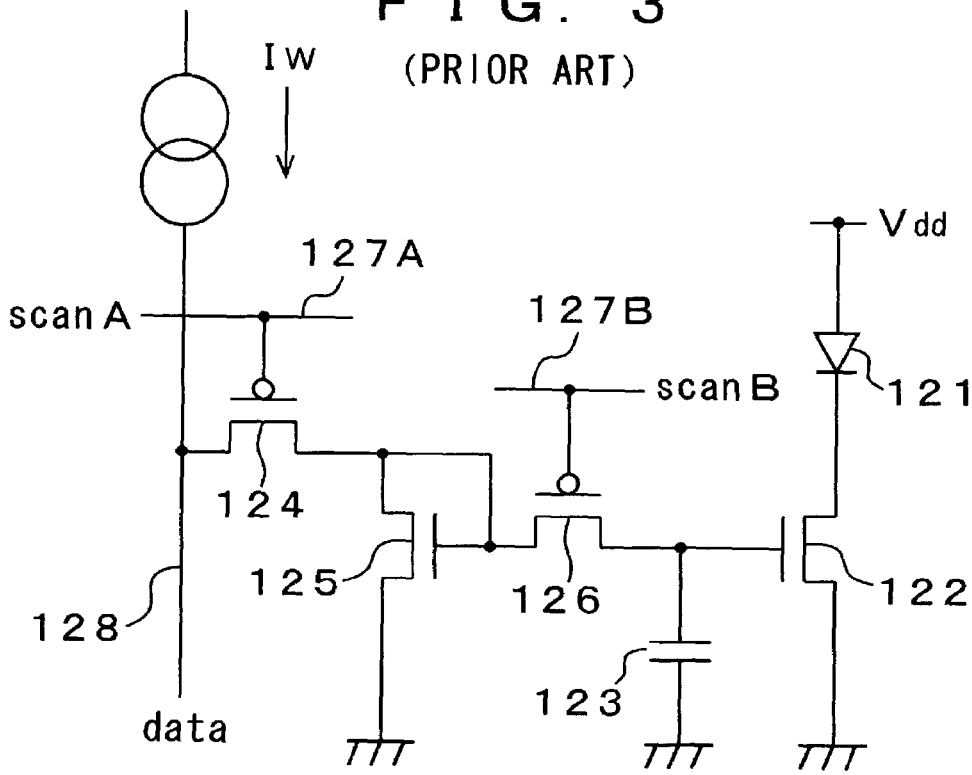
FIG. 3 (PRIOR ART)
FIG. 3 is a circuit diagram of a current-writing type pixel circuit according to prior application.
Figure 2:
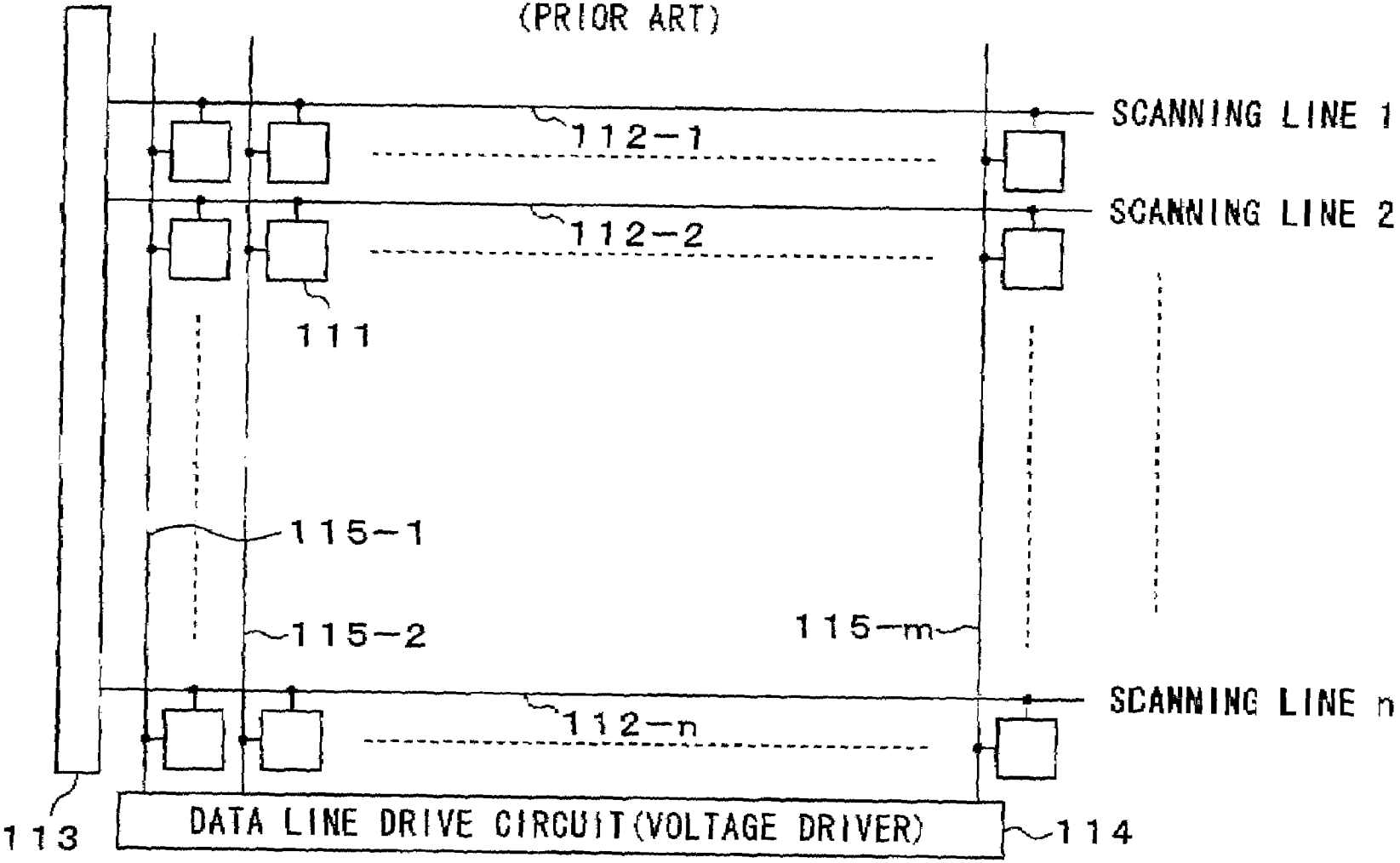
FIG. 2 (PRIOR ART)
FIG. 2 is a block diagram showing a configuration example of a conventional active matrix type display device utilizing pixel circuits.
Figures 4A, 4B, 4C, 4D:
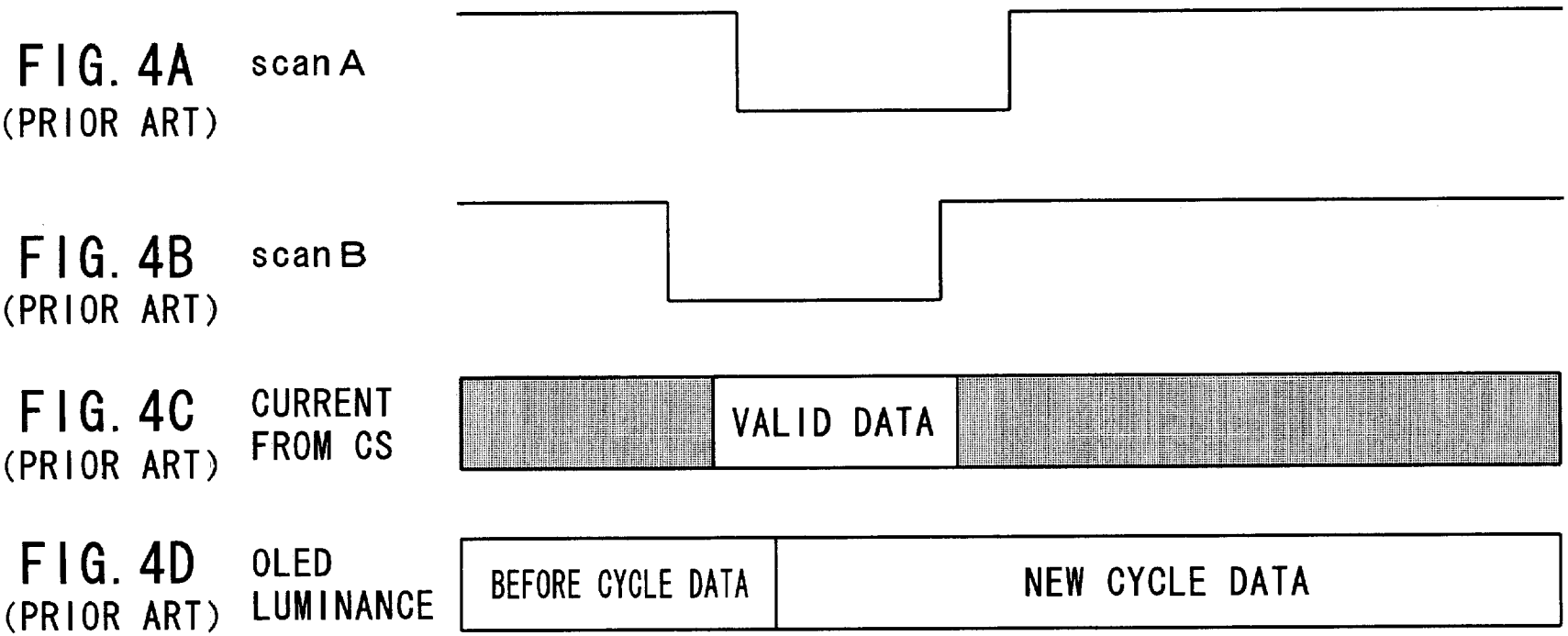
FIG. 4A (PRIOR ART)
FIG. 4B (PRIOR ART)
FIG. 4C (PRIOR ART)
FIG. 4D (PRIOR ART)
FIG. 4A is a timing chart showing timing of signal scanA for a scanning line 127A of the current-writing type pixel circuit of FIG. 3.
FIG. 4B is a timing chart showing timing of signal scanB for scanning line 127B.
FIG. 4C is a timing chart showing active current data of the current driver CS.
FIG. 4D is a timing chart showing OLED luminance information.
Figure 5:
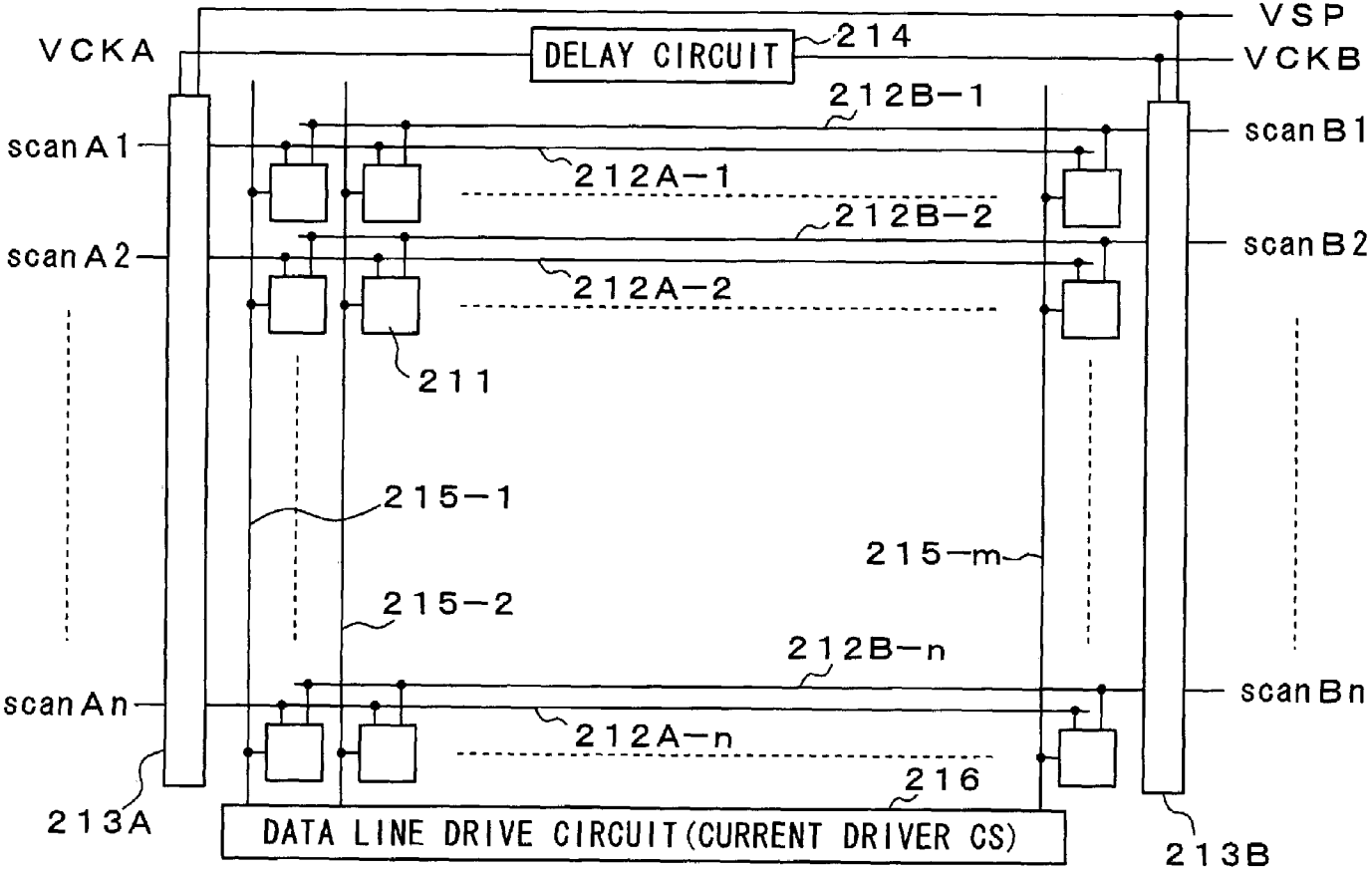
FIG. 5 (PRIOR ART)
FIG. 5 is a block diagram of an active matrix type display device utilizing current-writing type pixel circuits in accordance with prior application.

That is, the two pixel circuits P1 and P2 of FIG. 6 behave in exactly the same way as the two pixel circuits of prior application as shown in FIG. 3. However, in the invention, the current-voltage conversion TFT 16 is shared between two pixels. Accordingly, one transistor may be omitted for every two pixels. As noted previously, the magnitude of the current Iw is extremely larger than the current flowing through the OLED. The current-voltage conversion TFT 16 must be large sized to directly deal with such large current Iw. Hence, it is possible to minimize that portion of the area occupied by the TFTs in the pixel circuits by configuring the current-voltage conversion TFT 16 to be shared between the two pixels as shown in FIG. 6.

Figure 7:
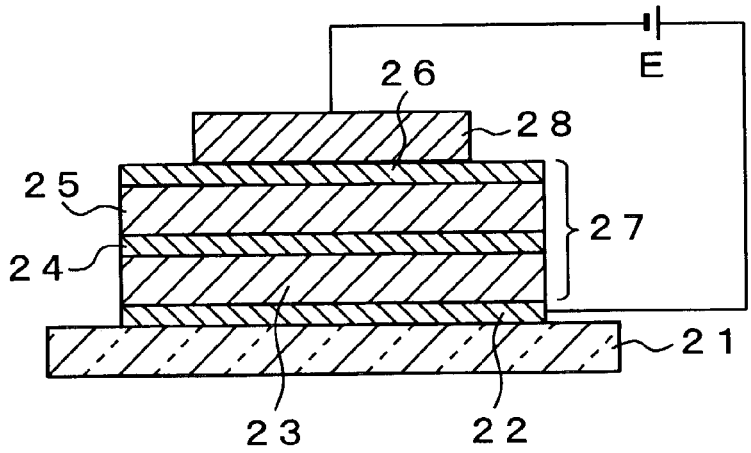
FIG. 7 is a cross sectional view of an exemplary organic EL element.

As an example, a structure of the organic EL element will be described. FIG. 7 shows a cross section of an organic EL element. As apparent from FIG. 7, the organic EL element is formed of a substrate 21 made of, for example, a transparent glass, and a first electrode 22 made of transparent conductive layer (for example, anode) on the substrate 21. Further, on the first electrode 22, a positive hole carrier layer 23, a light emitting layer 24, electron carrier layer 25 and an electron injection layer 26 are deposited in order, thereby forming organic layers 27. Thereafter, a second metallic electrode (for example, cathode) 28 is formed on the organic layers 27. Applying DC voltage E across the first electrode 22 and the second electrode 28 causes the light emitting layer 24 to emit light when electrons and positive holes are recombined.

In the pixel circuit having such an organic EL element (OLED), TFTs formed on the glass substrate are used as active elements as previously described, for reasons as stated below.

Because the organic EL display device is a direct view type one, it is relatively large in size. Hence, due to limitations in cost and production capability, it is not realistic to use a single crystalline silicon substrate as the active element. Further, in order to allow the light to be emitted from the light emitting part, a transparent conductive layer of indium tin oxide (ITO) is normally used as the first electrode (anode) 22 as shown in FIG. 7. Mostly, the ITO film is formed at a high temperature which is generally too high for the organic layer 27, and in such a case, the ITO layer must be formed before the organic layer 27 is formed. Hence, in general, the manufacture thereof proceeds as follows.

Figure 8:
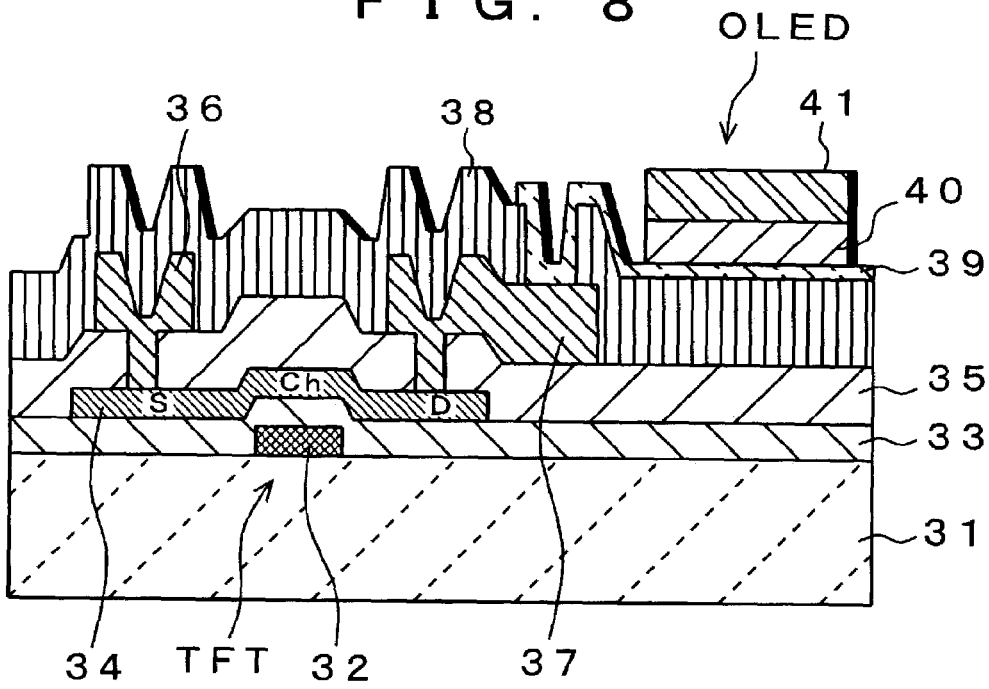
FIG. 8 is a cross sectional view of a pixel circuit for extracting light from the backside side of a substrate.

Manufacturing processes of TFT and organic EL element in the pixel circuits for use in the organic EL display device will be described below referring to the cross sectional view of FIG. 8.

First, a gate electrode 32, a gate insulation layer 33, and a semiconductor thin film 34 of amorphous (i.e. non-crystalline) silicon are formed in sequence through deposition and patterning of the respective layers, thereby forming a TFT on the glass substrate 31. On top of the TFT, an interlayer insulation film 35 is formed, and then a source electrode 36 and a drain electrode 37 are electrically connected to the source region (S) and the drain region (D) of the TFT across the interlayer insulation film 35. A further interlayer insulation film 38 is deposited thereon.

In some cases, the amorphous silicon may be transformed into polysilicon by a heat treatment such as laser annealing. In general, polysilicon has larger carrier mobility than amorphous silicon has, thereby permitting production of a TFT having a larger current drivability.

Next, a transparent electrode 39 of ITO is formed as the anode (corresponding to the first electrode 22 of FIG. 7) of the organic EL element (OLED). Then, an organic El layer 40 (corresponding to the organic layer 27 of FIG. 7) is deposited thereon to form an organic EL element. Finally, a metallic layer (e.g. aluminum) is deposited, which will be later formed into the cathode 41 (corresponding to the second electrode 28 of FIG. 7).

Figure 9:
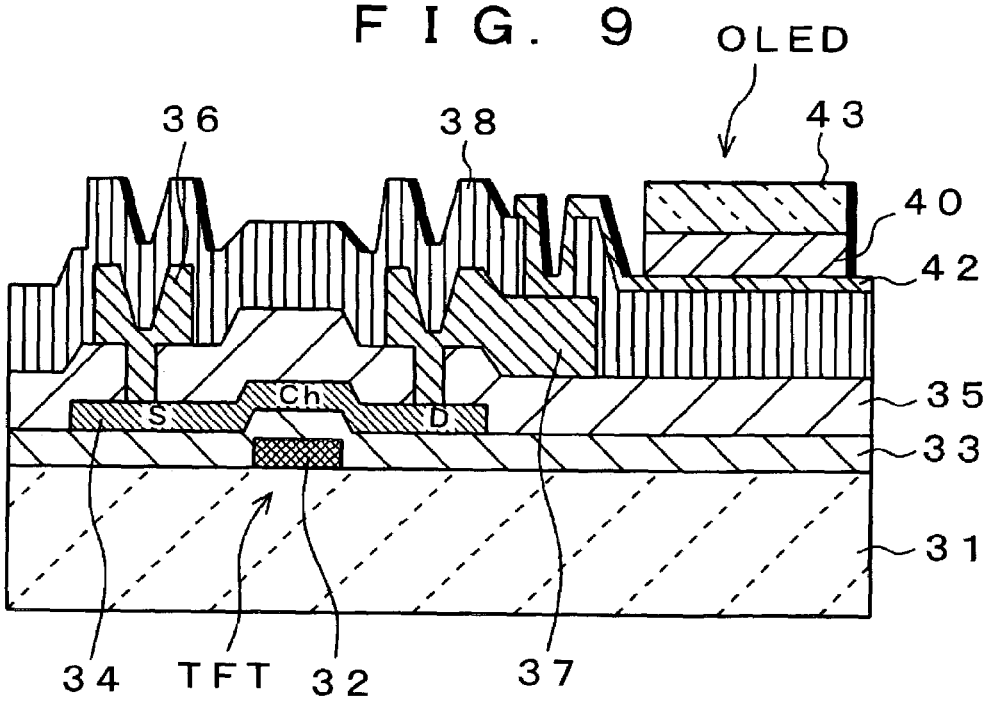
FIG. 9 is a cross sectional view of a pixel circuit for extracting light from the front surface side of a substrate.

In the arrangement described above, light is taken out from the backside (under side) of the substrate 31. Hence, it is necessary that the substrate 31 should be made of a transparent material (which is normally a glass). For this reason, a relatively large glass substrate 31 is used in an active matrix type organic EL display device, and as active elements, TFT that can be deposited on the substrate is usually used. An arrangement that light can be taken out from the front (upper) face of the substrate 31 has been recently adopted. A cross sectional view of such the arrangement is shown in FIG. 9. This arrangement differs from the one shown in FIG. 8 in that a metallic electrode 42, an organic EL layer 40, and a transparent electrode 43 are sequentially deposited on the interlayer insulation film 38, thereby forming an organic EL element.

As would be apparent from the above shown cross sectional view of the pixel circuit, in the active matrix type organic EL display device adapted to release light from the backside of the substrate 31, light emitting part of the organic EL element is positioned in vacant space between the TFTs after the TFTs are formed. This means that, if the transistors forming the pixel circuits are large, they occupy much of the area in the pixels, and lessen the area for the light emitting part.

In contrast, the pixel circuit of the invention has the arrangement as shown in FIG. 6, in which the current-voltage conversion TFT 16 is shared between two pixels, the area occupied by the TFTs is decreased and hence the area for the light emitting parts can be increased accordingly. If the light emitting part is not increased, the size of the pixel may be decreased, so that a display device of a higher resolution can be realized.

Alternatively, in the circuit arrangement as shown in FIG. 6, one transistor can be omitted for every two pixels, which increases the degree of freedom in the layout design of the current-voltage conversion TFT 16. In this case, as described previously in connection with the related art, a large channel width W is allowed for the TFT 16, and thus, a high precision current mirror circuit can be designed without recklessly decreasing the channel length L.

In the circuit shown in FIG. 6, a pair of the TFT 16 and TFT 12-1 and a pair of the TFT 16 and TFT 12-2 form respective current mirrors, whose characteristics, e.g. threshold Vth, are preferably identical. Hence, the transistors forming the current mirrors are preferably disposed in close proximity to each other.

Although the TFT 16 is shared between the two pixels 1 and 2 in the circuit of FIG. 6, it will be apparent that the TFT 16 can be shared between more than two pixels. In this case, further reduction of the size of a pixel circuit and hence the occupied area in the pixel circuit, is possible. However, in a case where a current-voltage conversion transistor is shared between multiple pixels, it might be difficult to dispose all the OLED drive transistors (e.g. TFT 12-1 and TFT 12-2 of FIG. 6) close to that current-voltage conversion transistor (e.g. TFT 16 of FIG. 6).

Figure 10:
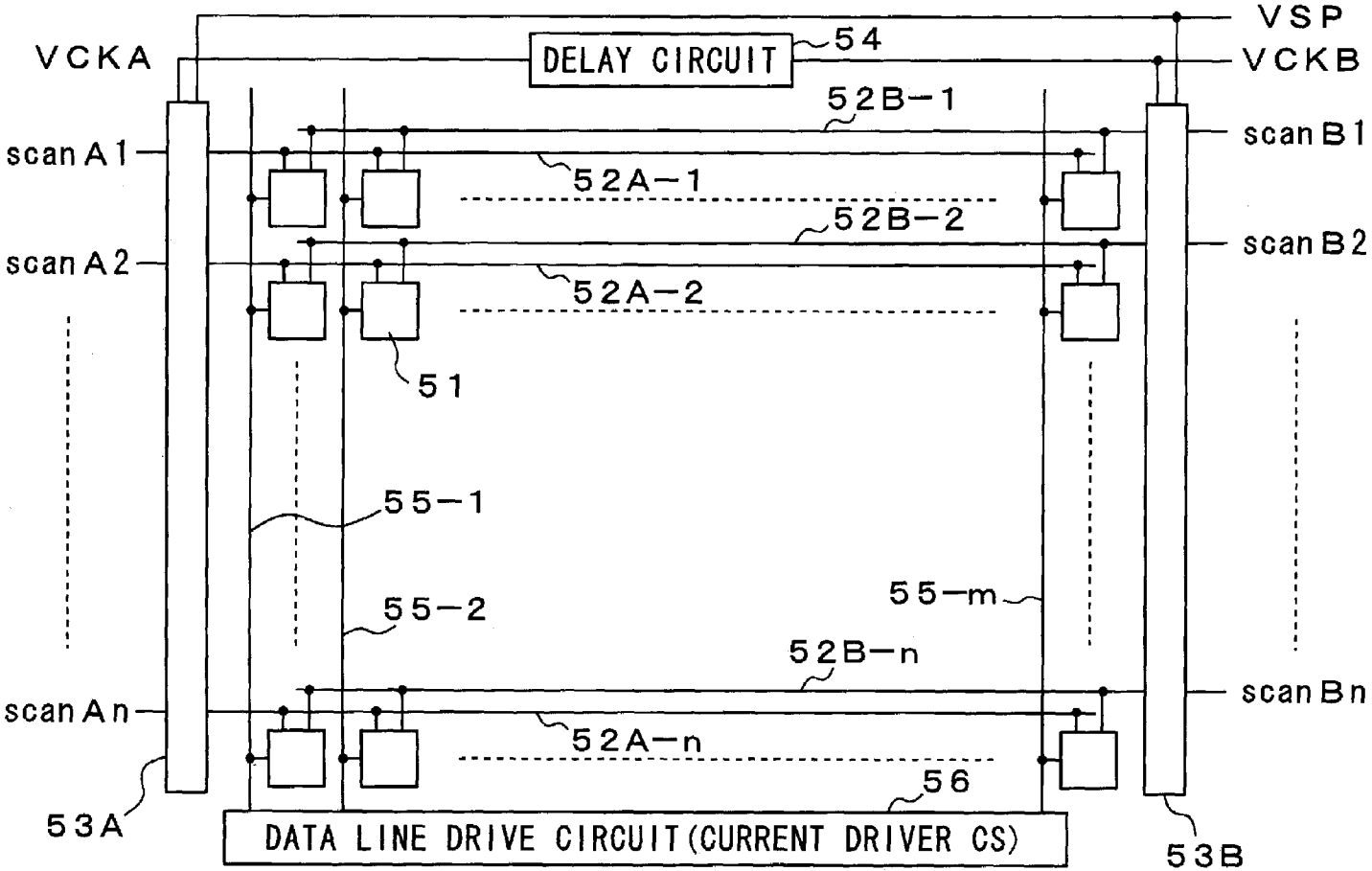
FIG. 10 is a block diagram showing a first embodiment of an active matrix type display device utilizing a first current-writing pixel circuit according to the invention.

As described above, an active matrix type display device, which is an active matrix type organic EL display device in the example shown herein, can be formed by arranging current-writing type pixel circuits in accordance with the first embodiment of the invention in a matrix form. FIG. 10 is a block diagram showing such active matrix type organic EL display device.

As shown in FIG. 10, connected to each of current-writing type pixel circuits 51 arranged in m-by-n matrix are respective first scanning lines 52A-1–52A-n and respective second scanning lines 52B-1–52B-n in a row-by-row basis. In each pixel, the gate of the scanning TFT 14 (14-1, 14-2) of FIG. 6 is connected to any one of the first scanning lines 52A-1–52A-n, respectively, and the gate of the scanning TFT 15 (15-1, 15-n) of FIG. 6 is connected to any one of the second scanning lines 52B-1–52B-n, respectively.

Provided on the left side of the pixel section is a first scanning line drive circuit 53A for driving the scanning lines 52A-1–52A-n, and provided on the right side of the pixel section is a second scanning line drive circuit 53B for driving the second scanning lines 52B-1–52B-n. The first and second scanning line drive circuits 53A and 53B are formed of shift registers. These scanning line drive circuits 53A and 53B are each supplied with a common vertical start pulse VSP and vertical clock pulses VCKA and VCKB. The vertical clock pulse VCKA is slightly delayed by a delay circuit 54 with respect to the vertical clock pulse VCKB.

Also, each pixel circuit 51 in a column is provided with any one of the respective data line 55-1–55-m. These data lines 55-1–55-m are connected at one end thereof to the current drive type data line drive circuit (current driver CS) 56. Luminance information is written to each pixel by the data line drive circuit 56 through the data lines 55-1–55-m.

Operations of the active matrix type organic EL display device described above will now be described. As a vertical start pulse VSP is fed to the first and the second scanning line drive circuits 53A and 53B, these scanning line drive circuits 53A and 53B start shifting operations upon receipt of the vertical start pulse VSP, thereby sequentially outputting scanning pulses scanA1–scanAn and scanB1–scanB1n in synchronism with the vertical clock pulses VCKA and VCKB to sequentially select the scanning lines 52A-1–52A-n and 52B-1–52B-n.

On the other hand, the data line drive circuit 56 drives each of the data lines 55-1–55-m with current values in accordance with the pertinent luminance information. This current flows through the pixels that are connected to the scanning line selected, carrying out the current-writing operation by the scanning line. This causes each of the pixels to start emission of light with intensity in accordance with the current values. It is noted that since the vertical clock pulse VCKA slightly lag the vertical clock pulse VCKB, the scanning lines 18B-1 and 18B-2 become non-selective prior to the scanning lines 18A-1 and 18A-2, as shown in FIG. 6. At the point in time the scanning lines 18B-1 and 18B-2 have become non-selective, luminance data is held in the capacitor 13-1 and 13-2 within the pixel circuit, so that each pixel remains lighted at a constant luminance until new data is written into next frame.

First Modification of the First Embodiment

Figure 11:
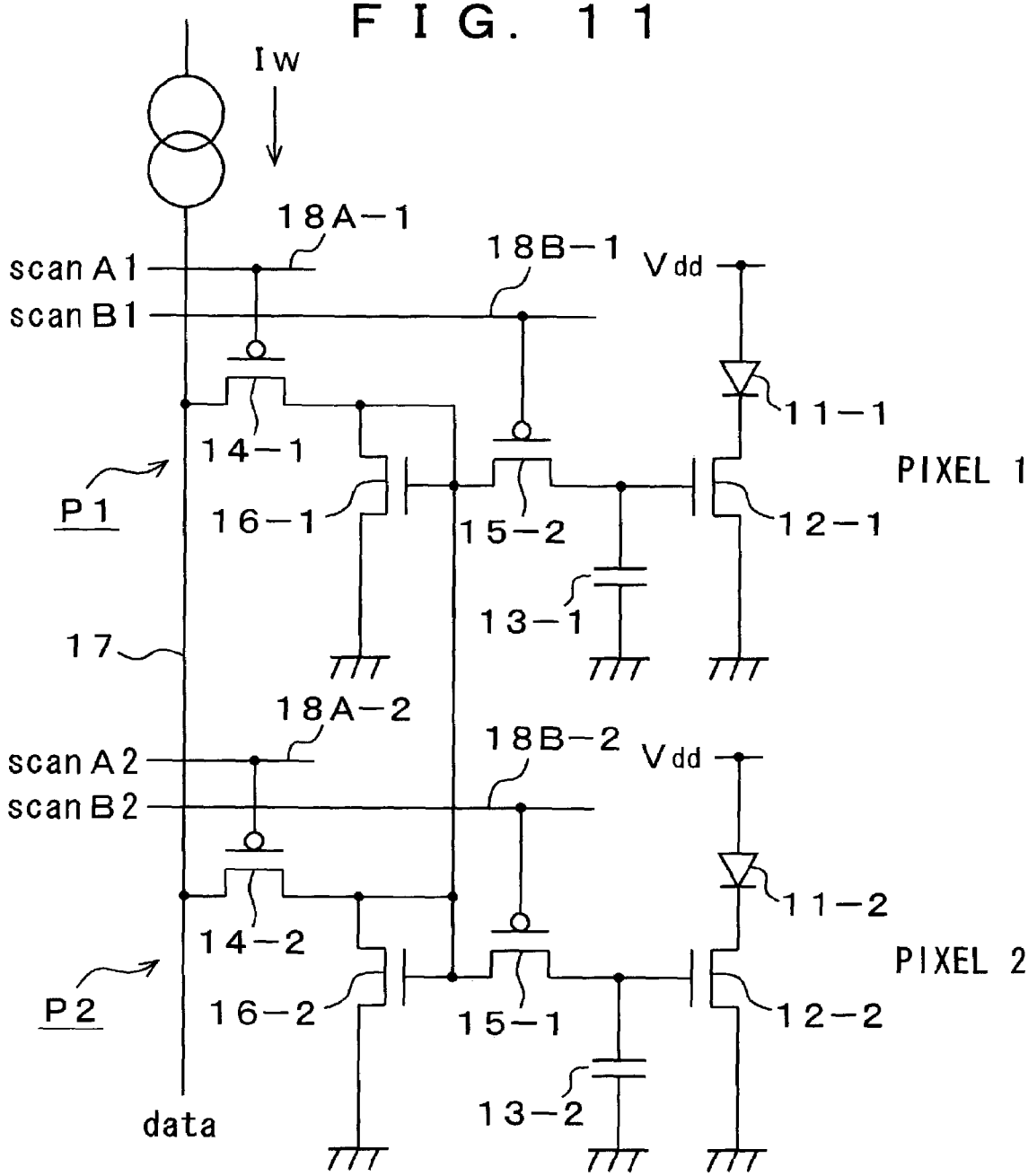
FIG. 11 is a circuit diagram of a first pixel circuit obtained by modifying the first embodiment.

FIG. 11 is a circuit diagram showing a first modification of the pixel circuit in accordance with the first embodiment. Like reference numerals in FIGS. 11 and 6 represent like or corresponding elements. Again, for simplicity of illustration, only two pixel circuits of two neighboring pixels (denoted as pixels 1 and 2) in a column are illustrated.

In the first modification, current-voltage conversion TFTs 16-1 and 16-2 are respectively provided in pixel circuits P1 and P2. This configuration apparently seems to be similar to the pixel circuit shown in FIG. 3 in connection with prior application. However, the pixel circuit is different from the one shown in FIG.3 in that the drain gate couplings of the diode connected TFTs 16-1 and 16-2 are further coupled together for common use between the pixel circuits P1 and P2.

That is, in these pixel circuits P1 and P2, the sources of the TFTs 16-1 and 16-2 are grounded so that they are functionally equivalent to a single transistor element. Thus, the circuit shown in FIG. 11 having the drain-gate couplings of TFTs 16-1 and 16-2 commonly coupled is practically the same as the circuit shown in FIG. 6 having TFT16 shared between two pixels.

Because the TFTs 16-1 and 16-2 together are equivalent to a single transistor element, and because writing current Iw flows through the TFTs 16-1 and 16-2, the channel width of each of the TFTs 16-1 and 16-2 can be equal to the one to which the channel width of the current-voltage conversion TFT 125 of the pixel circuit shown in FIG. 3 in connection with the prior application is halved, as compared with the pixel circuit shown in FIG. 3 in connection with the prior application. As a result, the area occupied by the TFTs in the pixel circuit can be made smaller than that of the pixel circuits in connection with the prior application.

It will be apparent that the configuration described above in the first modification can be applied not only to two pixels but also to more than two pixels as in the first embodiment.

Second Modification of the First Embodiment

Figure 12:
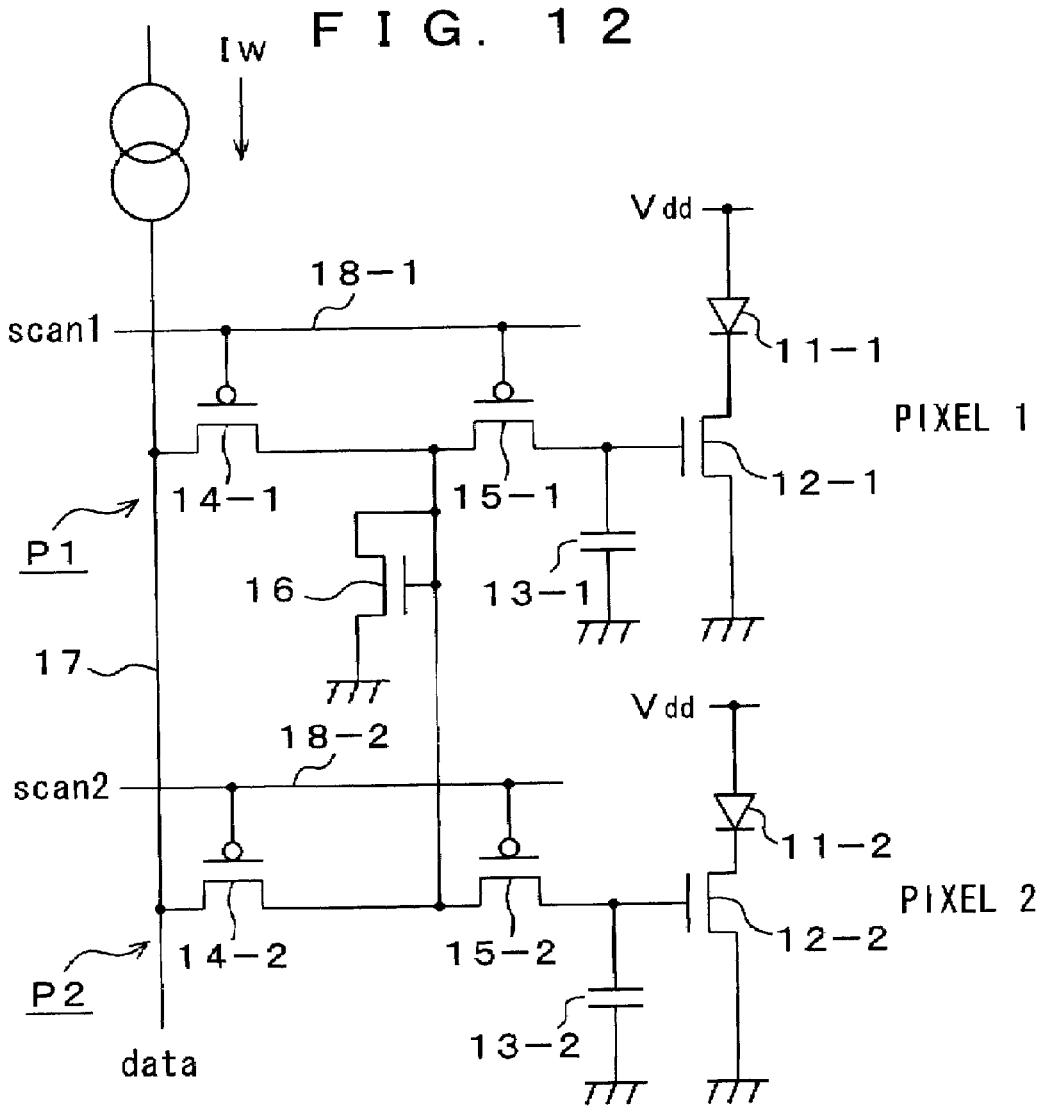
FIG. 12 is a circuit diagram of a second pixel circuit obtained by modifying the first embodiment.

FIG. 12 shows a circuit diagram showing a second modification of a pixel circuit in accordance with the first embodiment. Like reference numerals in FIGS. 12 and 6 represent like or corresponding elements. In this second modification also, only two neighboring pixels (pixels 1 and 2) in a column are shown for simplicity of illustration.

In the second modification, scanning line is (18-1 and 18-2) are respectively provided to each pixel one by one, so that the gates of the TFTs 14-1 and 15-1 are connected in common to the scanning line 18-1 while the gates of the scanning TFTs 14-2 and 15-2 are connected in common to the scanning line 18-2n this respect, this modified pixel circuit differs from the one according to the first embodiment in which both of two scanning lines are provide to each pixel.

In operation, row-wise scanning is performed by a single scanning signal in the second modification, in contrast to the first embodiment where row-wise scanning is performed by a set of two scanning signals (A and B). However, the second modification is equivalent to the first embodiment not only in configuration of the pixel circuit but also in function thereof.

Second Embodiment

Figure 13:
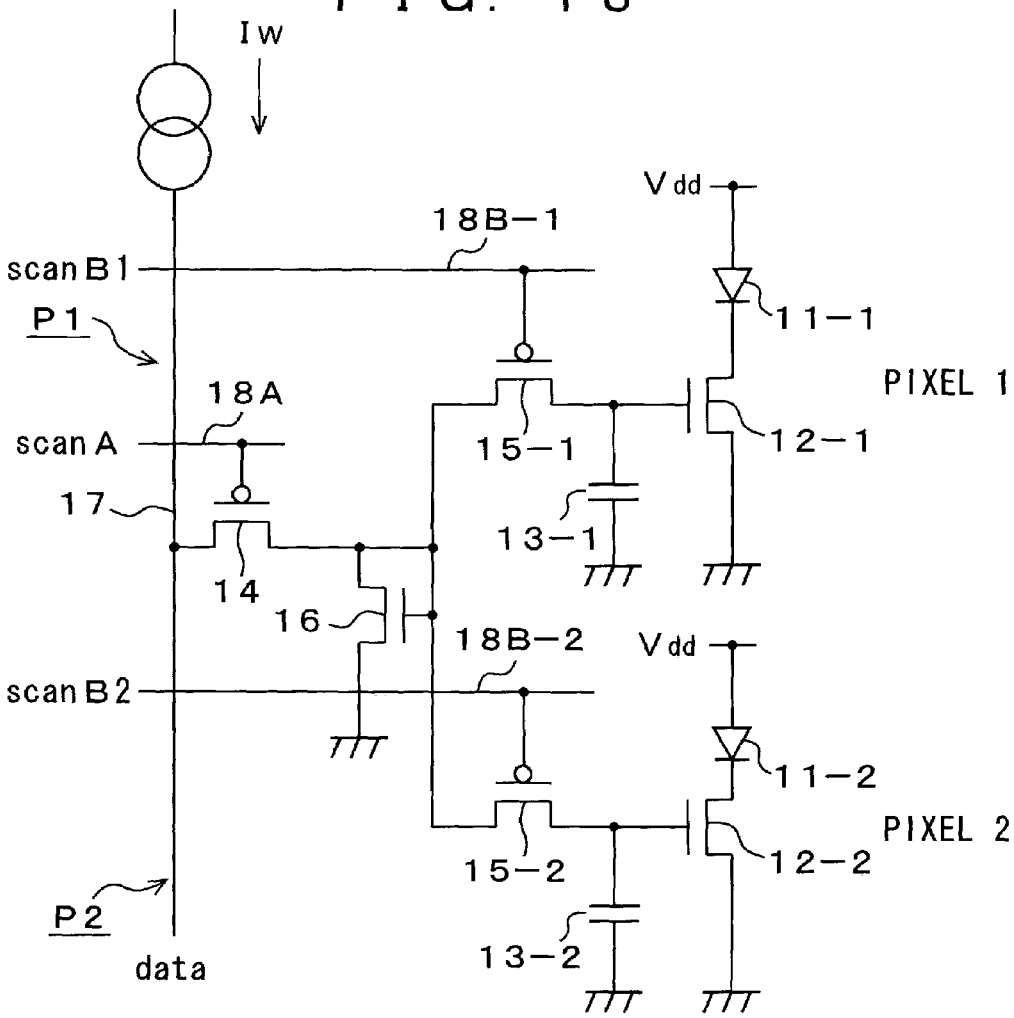
FIG. 13 is a circuit diagram showing a second embodiment of a current-writing type pixel circuit according to the invention.

FIG. 13 is a circuit diagram showing a second embodiment of a current-writing type pixel circuit according to the invention. Like reference numerals in FIGS. 13 and 6 represent like or corresponding elements. Here, for simplicity of illustration, only two neighboring pixels (pixels 1 and 2) in a column are shown.

As compared to the first embodiment in which a current-voltage conversion TFT 16 is shared between two pixels, the pixel circuit of the second embodiment has an the first scanning TFT 14 serving as a first scanning switch is also shared between two pixels. That is, regarding "A" group of scanning lines, one scanning line 18A is provided to every two pixels, and the gate of single scanning TFT 14 is connected to the scanning line 18A, and the source of the scanning TFT 14 is connected to the drain and the gate of the current-voltage conversion TFT 16 and to the drains of the scanning TFTs 15-1 and 15-2 serving as a second scanning switch.

The scanning line 18A of the "A" group shown in FIG. 13 is supplied with a timing signal scanA. The scanning line 18B-1 of B group is supplied with a timing signal scanB1, while the scanning line 18B-2 is supplied with a timing signal scanB-2. OLED luminance information (luminance data) is supplied to the data line 17. The current driver CS feeds bias current Iw to the data line 17 in accordance with active current data based on the OLED luminance information.

Writing operations of luminance data to a current-writing type pixel circuit in accordance with the second embodiment described above will now be described.

First, consider writing luminance data to the pixel 1. In this case, the current Iw is provided with the data line 17 in accordance with the luminance data with both of the scanning lines 18A and 18B-1 being selected (in the example shown herein, scanning signals scanA and scanB 1 are both LOW levels). The current Iw is supplied to the TFT 16 via the currently conductive TFT 14. Because of the current Iw flowing through the TFT 16, voltage corresponding to the current Iw is generated on the gate of the TFT 16. This voltage is held in the capacitor 13-1.

This causes current to flow through the OLED 11-1 via the TFT 12-1 in response to the voltage held in the capacitor 13-1. Thus, an emission of light starts in the OLED 11-1. The writing of the luminance data to pixel 1 is completed when both the scanning lines 18A and 18B-1 assume non-selective status (scanning signal scanA and scanB 1 being pulled to HIGH levels). During the sequence of steps described above, scanning line 18B-2 stays in the non-selective status, so that OLED 11-2 of the pixel 2 keeps on emitting light with the luminance determined by the voltage held in the capacitor 13-2, without being affected by the writing to the pixel 1.

Next, consider writing luminance data to the pixel 2. This can be done by selecting both of the scanning lines 18A and 18B-2 (with scanning signal scanA and scanB-2 being LOW levels), and by supplying current Iw to the data line 17 in accordance with the luminance data. Because of the current Iw flowing through the TFT 16 via the TFT 14, voltage corresponding to the current Iw is generated on the gate of the TFT 16. This voltage is held in the capacitor 13-2.

Current that corresponds to the voltage held in the capacitor 13-2 flows through the OLED 11-2 via the TFT 12-2, thereby causing the OLED 11-2 to emit light. During the sequence of the steps described above, scanning line 18B-1 maintains the non-selective status, so that OLED 11-1 of the pixel 1 continues emitting light with the luminance determined by the voltage held in the capacitor 13-1, without being affected by the writing to the pixel 2.

Although the scanning line 18A must be selected during the writing to the pixels 1 and 2 as described above, the scanning line 18A may be reset to the non-selective status at a suitable timing after the completion of writing to the two pixels 1 and 2. Control of the scanning line 18A will now be described.

Figure 14:
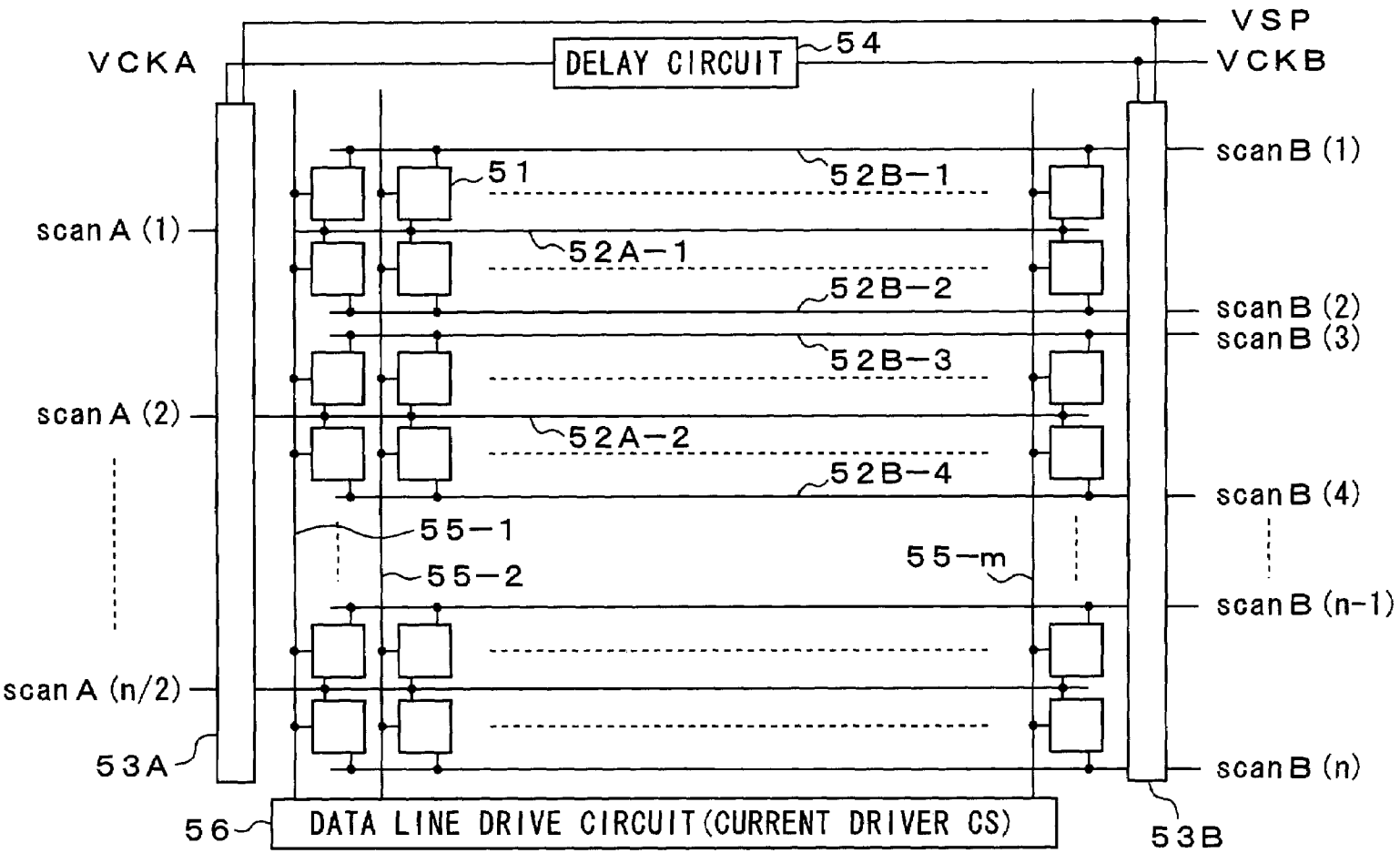
FIG. 14 is a block diagram showing an active matrix type display device utilizing the second embodiment of the current-writing pixel circuit according to the invention.

As described above, an active matrix type display device, which is an active matrix type organic EL display device in the example shown herein, can be formed by arranging the above pixel circuits in accordance with the second embodiment in a matrix form. FIG. 14 is a block diagram showing such active matrix type organic EL display device. Like reference numerals in FIGS. 14 and 10 represent like or corresponding elements.

In the active matrix type organic EL display device according to this embodiment, the first scanning lines 52A-1, 52A-2 . . . are provided to each of the pixel circuits 51 arranged in a matrix of m columns by n rows, with one scanning line for every two rows (i.e. one scanning line for two pixels). Hence, the number of the first scanning lines 52A-1, 52A-2, . . . is one half the number n of the pixels in a vertical direction (=n/2).

On the other hand, the second scanning lines 52B-1, 52B-2 . . . are provided with one scanning line for each row. Hence, the number of the second scanning lines 52B-1, 52B-2, . . . equals n. In each pixel, the gate of the scanning TFT 14 shown in FIG. 13 is connected to the first scanning lines 52A-1, 52A-2 . . . respectively, and the gates of the scanning TFTs 15 (15-1 and 15-2) are connected to the second scanning lines 52B-1, 52B-2 . . . respectively.

FIGS. 15A–15G are timing charts each for writing operations in the above active matrix type organic EL display device. The timing charts represent writing operations for four pixels in the 2k−1$^{st}$ row through 2k+1$^{st}$ row (k being an integer) counting from top to bottom.

Figure 15:
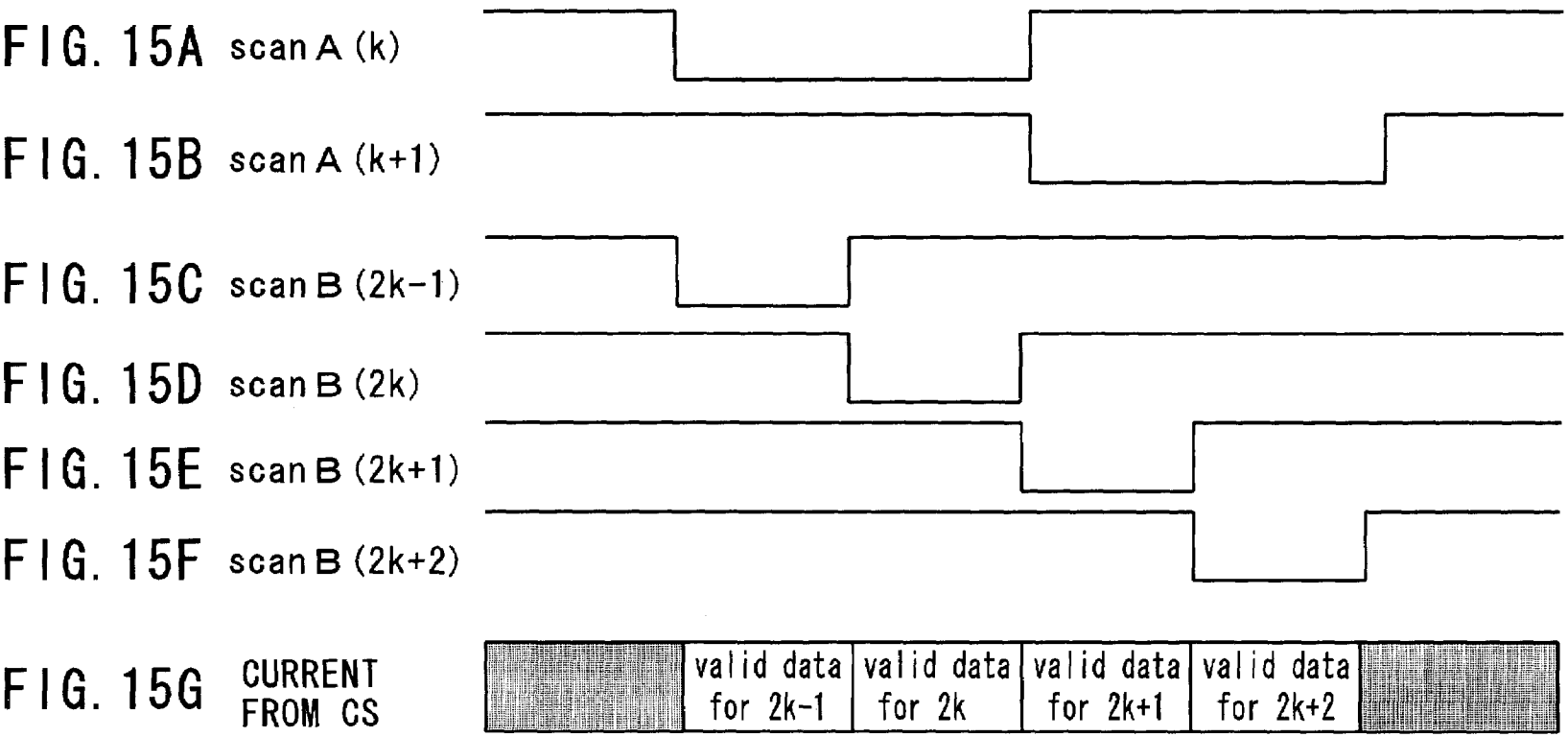
FIG. 15A is a timing chart showing timing of signal scanA (K of the current-writing type pixel circuit shown in FIG. 14.
FIG. 15B is a timing chart showing timing of signal scanA (K+1)
FIG. 15C is a timing chart showing timing of signal scanB (2K−1)
FIG. 15D is a timing chart showing timing of scanning scanB (2K)
FIG. 15E is a timing chart showing timing of scanning scanB (2K+1)
FIG. 15F is a timing chart showing timing of scanning scanB (2K+2)
FIG. 15G is a timing chart showing active current data of the current driver CS.

In writing to the pixels in the 2k−1$^{st}$ and 2k$^{th}$ rows, scanning signal scanA (k) is set to the selective status (which is LOW level in the example shown herein) as shown in FIG. 15A. During this period, selecting the scan signal scanB (2k−1) as shown in FIG. 15C and the scan signal scanB (2k) as shown in FIG. 15D in sequence allows the writing to the two pixels in these rows to be made. Next, in writing to the pixels in the rows 2k+1$^{st}$ and 2k+2$^{nd}$, the scanning signal scanA (k+1) as shown in FIG. 15B is set to the selective status (which is LOW level in the example shown herein). During this period, sequentially selecting the scanning signal scanB (2k+1) as shown in FIG. 15E and the scanning signal scanB (2k+2) as shown in FIG. 15F allows the writing to the two pixels in these rows to be accomplished. FIG. 15G shows active current data in the current driver CS 56.

As described above, in the pixel circuit in accordance with the second embodiment, the scanning TFT 14 and the current-voltage conversion TFT 16 are shared between two pixels. Hence, the number of transistors per two pixels is six, which is less than that of the pixel circuit shown in FIG. 3 in connection with prior application by 2. Nevertheless, the inventive pixel circuit can attain the same writing operation as the pixel circuit in connection with the prior application.

It is noted that, like the current-voltage conversion TFT 16, in order for the scanning TFT 14 to deal with extremely large current Iw as compared with the current through the OLED (organic EL element), the TFT 14 must have large dimensions, and hence occupy a large area in the pixel. Therefore, the circuit configuration as shown in FIG. 13 helps advantageously minimize the occupied area in the pixel circuit that is occupied by the TFTs, since not only the current-voltage conversion TFT 16 but also the scanning TFT 14 are shared between two pixels in this configuration. It is thus possible in the second embodiment to attain much a higher resolution than the first embodiment by enlarging the dimensions of the light emitting part or reducing the pixel size.

Although, in this embodiment, the scanning TFT 14 and the current-voltage conversion TFT 16 are also shared between two pixels, it will be apparent that they can be shared between more than two pixel circuits. In that case, merits of reducing the number of the transistors are significant. However, sharing of the scanning TFT 14 between too many transistors will make it difficult to arrange so many OLED drive transistors (e.g. TFTs 12-1 and 12-2 of FIG. 13) close to the current-voltage conversion transistor (e.g. TFT 16 of FIG. 13) in each pixel circuit.

In the embodiment described herein, the scanning TFT 14 and the current-voltage conversion TFT 16 are presumably shared between a multiplicity of pixels. However, it is also possible to have only the scanning TFT 14 shared between the multiple pixels.

Modification of the Second Embodiment

Figure 16:
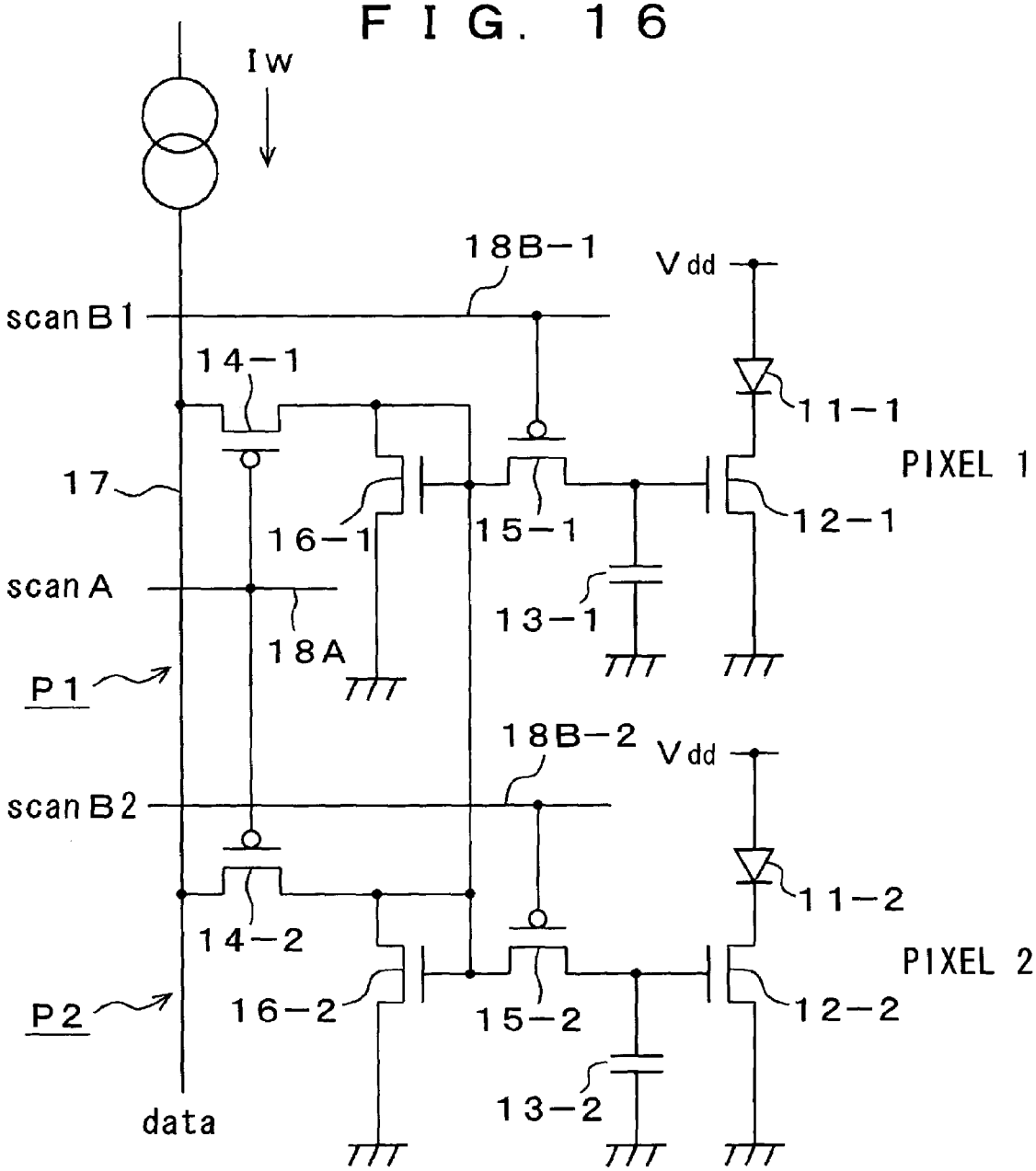
FIG. 16 is a circuit diagram of a modified pixel circuit obtained by modifying the second embodiment of the invention.

FIG. 16 is a circuit diagram showing a modification of the pixel circuit in accordance with the second embodiment. Like reference numerals in FIGS. 16 and 13 represent like or corresponding elements. Again, for simplicity of illustration, only two pixel circuits of two neighboring pixels (denoted by pixels 1 and 2) in a column are illustrated.

In the pixel circuit in accordance with this modification, pixel circuits P1 and P2 are respectively provided with the scanning TFTs 14-1 and 14-2 and the current-voltage conversion TFTs 16-1 and 16-2. Specifically, the gates of the respective scanning TFTs 14-1 and 14-2 are connected in common to the scanning line 18A. The respective drains and the gates of the diode-connected TFTs 16-1 and 16-2 are connected in common to each other between pixel circuits P1 and P2, and further connected to the sources of the scanning TFTs 14-1 and 14-2.

As is apparent from the above connection relationship, since the scanning TFTs 14-1 and 14-2 and the current-voltage conversion TFTs 16-1 and 16-2 are respectively connected in parallel, they are functionally equivalent to a single transistor element. In this regard, the circuit shown in FIG. 16 is substantially equivalent to the one shown in FIG. 13.

In the pixel circuit in accordance with this modification, the number of transistors is the same as that of transistors for two pixels of the pixel circuit shown in FIG. 3 in connection with the prior application. However, in this configuration, since writing current Iw flows through the TFT 14-1 and TFT 14-2, and through the TFTs 16-2 and 16-2, the channel width of these transistors can be equal to the one to which that of the pixel circuit in connection with the prior application is halved. Accordingly, as in the pixel circuit in accordance with the second embodiment, the area occupied by the TFTs in the pixel circuit can be extremely reduced.

Although in all of the embodiments and their modifications described above, the transistors forming current mirror circuits are presumably N-channel MOS transistors, and the scanning TFTs are p-channel MOS transistors. However, it should be understood that these embodiments have been presented for purposes of illustration and description, and not to limit the invention in the form disclosed.

INDUSTRIAL UTILITY OF THE INVENTION

As described above, an active matrix type display device, an active matrix type organic EL display device, and a method of driving these display devices in accordance with the invention enable current-voltage conversion parts and/or scanning switches to be shared between at least two pixels so that these current-voltage conversion parts and scanning switches allow a large current as compared with light emitting elements (electro-optical elements). Because of this arrangement, the area occupied by pixel circuits per pixel can be reduced. Thus, it is possible to increase the area of light emitting part and/or reduce the size of pixels for a higher resolution. The invention may also increase a degree of freedom in the layout design of a drive circuit, thereby forming a pixel circuit with a high accuracy.

The invention claimed is:

1. An active matrix type display device including current-writing type pixel circuits arranged in a matrix form for allowing current to pass through said pixel circuits via a data line in accord with luminance to write luminance information thereinto, each pixel circuit having an electro-optical element whose luminance varies with the current passing therethrough, and said pixel circuit comprising:

a conversion part for converting the current provided from the data line into voltage; a hold part for holding the voltage converted by said conversion part; and a drive part for converting the voltage held in said hold part into current and passing the converted current through said electro-optical element, wherein said conversion part is shared between at least two separate pixels in a row direction, wherein said conversion part has a first field effect transistor (FET) whose drain and gate are short-circuited, said transistor generating voltage across said gate and source when said transistor is supplied with current from said data line;

wherein said hold part has a capacitor for holding said voltage generated across said gate and source of said first FET; and wherein said drive part has a second FET connected in series with said electro-optical element for driving said electro-optical element in accordance with the voltage held in said capacitor.

2. The active matrix type display device according to claim 1, wherein said first and second FETs have substantially same characteristic and constitute current mirror circuit.

3. The active matrix type display device according to claim 1, wherein said first FET is a single transistor element shared between at least two separate pixels in a row direction.

4. The active matrix type display device according to claim 1, wherein said first FET includes a multiplicity of transistor elements having the drains and gates connected together, said transistor element being shared between at least two separate pixels in a row direction.

5. An active matrix type display device including current-writing type pixel circuits arranged in a matrix form for allowing current to pass through the pixel circuits via a data line in accord with luminance to write luminance information thereinto, each pixel circuit having an electro-optical element whose luminance varies with the current passing therethrough, said pixel circuit comprising:

a first scanning switch for selectively passing the current provided from said data line; a conversion part for converting the current provided through said first scanning switch into voltage;

a second scanning switch for selectively passing the voltage converted by said conversion part;

a hold part for holding the voltage supplied thereto through said second scanning switch; and a drive part for converting the voltage held in said hold part into current and passing the converted current through said electro-optical element, wherein said first scanning switch is shared between at least two separate pixels in a row direction, wherein said first scanning switch includes a first FET having a gate connected to a first scanning line;

wherein said conversion part includes a second FET having a drain and a gate thereof short circuited for generating voltage across the gate and the source thereof when current is supplied from the data line via said first FET;

wherein said second scanning switch includes a third FET having a gate connected to a second scanning line;

wherein said hold part includes a capacitor for holding the voltage generated across said gate and source of said second FET and supplied via said third FET; and wherein said drive part includes a fourth FET connected in series with said electro-optical element, for driving said electro-optical element in accordance with said voltage held in said capacitor.

6. The active matrix type display device according to claim 5, wherein said second and fourth FETs have substantially same characteristic and together constitute current mirror circuit.

7. The active matrix type display device according to claim 5, wherein said first or second FET is a single transistor element shared between at least two separate pixels in a row direction.

8. The active matrix type display device according to claim 5, wherein said first or second FET includes a multiplicity of transistor elements having their drains and gates connected together, said transistor element being shared between at least two separate pixels in a row direction.

9. An active matrix type organic electroluminescent display device including current-writing type pixel circuits arranged in a matrix form for allowing current to pass through the pixel circuits via a data line in accord with luminance to write luminance information thereinto, each pixel circuit utilizing as a display element organic electroluminescent element having a first electrode, a second electrode and layers of electroluminescent organic material, the layers being placed between the electrodes and including a light-emitting layer, said pixel circuit comprising:

a conversion part for converting the current provided from said data line into voltage; a hold part for holding the voltage converted by said conversion part; and a drive part for converting the voltage held in said hold part into current and passing the converted current through the organic electroluminescent element, wherein said conversion part is shared between at least two separate pixels in a row direction, wherein said conversion part has a first field effect transistor (FET) whose drain and gate are short-circuited, said transistor generating voltage across said gate and source when said transistor is supplied with current from said data line;

wherein said hold part has a capacitor for holding said voltage generated across said gate and source of said first FET; and wherein said drive part has a second FET connected in series with said electro-optical element, for driving said electro-optical element in accordance with the voltage held in said capacitor.

10. The active matrix type organic electroluminescent display device according to claim 9, wherein said first and second FETs have substantially same characteristic and together constitute current mirror circuit.

11. The active matrix type organic electroluminescent display device according to claim 9, wherein said first FET is a single transistor element shared between at least two separate pixels in a row direction.

12. The active matrix type organic electroluminescent display device according to claim 9, wherein said first FET includes a multiplicity of transistor elements having the drains and gates connected together, said transistor element being shared by at least two separate pixels in a row direction.

13. An active matrix type organic electroluminescent display device including current-writing type pixel circuits arranged in a matrix form for allowing current to pass through the pixel circuits via a data line in accord with luminance to write luminance information thereinto, each pixel circuit utilizing as a display element organic electroluminescent element having a first electrode, a second electrode and layers of electroluminescent organic material, said layers being placed between the electrodes and including a light-emitting layer, said pixel circuit comprising:

a first scanning switch for selectively passing the current provided from said data line;

a conversion part for converting the current provided through said first scanning switch into voltage;

a second scanning switch for selectively passing the voltage converted by said conversion part;

a hold part for holding the voltage supplied thereto through said second scanning switch; and a drive part for converting the voltage held in said hold part into current and passing the converted current through said electro-optical element, wherein said first scanning switch is shared between at least two separate pixels in a row direction, wherein said first scanning switch includes a first FET having a gate connected to a first scanning line;

wherein said conversion part includes a second FET having a drain and a gate thereof short circuited, for generating voltage across the gate and the source thereof when current is supplied from said data line via said first FET;

wherein said second scanning switch includes a third FET having a gate connected to a second scanning line;

wherein said hold part includes a capacitor for holding the voltage generated across said gate and source of said second FET and supplied via said third FET; and wherein said drive part includes a fourth FET connected in series with said electro-optical element, for driving said electro-optical element in accordance with said voltage held in said capacitor.

14. The active matrix type organic electroluminescent display device according to claim 13, wherein said second and fourth FETs have substantially same characteristic and together constitute current mirror circuit.

15. The active matrix type organic electroluminescent display device according to claim 13, wherein said first or second FET is a single transistor element shared between at least two separate pixels in a row direction.

16. The active matrix type organic electroluminescent display device according to claim 13, wherein said first or second FET includes a multiplicity of transistor elements having their drains and gates connected together, said transistor element being shared between at least two separate pixels in a row direction.

* * * * *